US006666697B2

(12) United States Patent
Yamashita

(10) Patent No.: US 6,666,697 B2
(45) Date of Patent: Dec. 23, 2003

(54) CONNECTOR ASSEMBLY

(75) Inventor: Kazunori Yamashita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/281,465

(22) Filed: Oct. 25, 2002

(65) Prior Publication Data

US 2003/0082940 A1 May 1, 2003

(30) Foreign Application Priority Data

Oct. 29, 2001 (JP) ..... 2001-330933
Oct. 30, 2001 (JP) ..... 2001-332454
Oct. 30, 2001 (JP) ..... 2001-332465

(51) Int. Cl.[7] ..... H01R 13/62

(52) U.S. Cl. ..... 439/157; 439/489; 439/342; 439/160; 439/152

(58) Field of Search ..... 439/157, 342, 439/347, 160, 152, 153, 154, 489, 488

(56) References Cited

U.S. PATENT DOCUMENTS 5,401,179 A 3/1995 Shinchi et al.
5,681,175 A * 10/1997 Busse et al. ..... 439/157
5,727,959 A * 3/1998 Yagi et al. ..... 439/157
6,203,340 B1 * 3/2001 Yamashita et al. ..... 439/157
6,210,185 B1 * 4/2001 Sakurai et al. ..... 439/157
6,264,485 B1 * 7/2001 Saka et al. ..... 439/157

FOREIGN PATENT DOCUMENTS

JP 4-319271 11/1992

* cited by examiner

*Primary Examiner*—Tho D. Ta
*Assistant Examiner*—Truc Nguyen
(74) *Attorney, Agent, or Firm*—Gerald E. Hespos; Anthony J. Cusella

(57) ABSTRACT

A connector assembly has first and second connectors (10, 40). A slider (30) can be slid on the first connector (10) from an initial position to a connection position. Detectors (39) are kept at a standby position before the slider (30) reaches a proper connection position to leave the connectors (10, 40) only partly connected, whereas the displacement of the detectors (39) to a detection position is permitted after the slider (30) reaches the connection position to properly connect the connectors (10, 40). Thus, a moved position of the slider (30) or the connected state of the connectors (10, 40) can be detected based on whether the detectors (39) can be displaced to the detection position.

13 Claims, 24 Drawing Sheets

CONNECTOR ASSEMBLY

BACKGROUND OF THE INVENTION

1. Field of the Invention

The present invention relates to a connector assembly.

2. Description of the Related Art

Japanese Unexamined Patent Publication No. 4-319271 discloses a connector assembly designed to improve connection operability. This assembly has first and second connectors that are connectable by movement along connecting directions. The first connector has a slider movable in a direction normal to the connecting directions and is formed with a cam groove oblique to both a moving direction of the slider and the connecting directions. The second connector includes a cam pin engageable with the cam groove.

The cam pin engages the entrance of the cam groove by lightly fitting the two connectors together. The slider then is moved and the connectors are pulled toward each other by the cam action of the cam groove and the cam pin. The two connectors are connected easily and securely even if an operation force given to the slider is small.

Frictional resistance between terminal fittings increases as the number of contacts between the terminal fittings increases, and a certain degree of force is required to operate the slider. An operator may inadvertently fail to move a slider completely to a proper connection position if a large operation force is required. Thus, the two connectors may be left only partly connected.

Human eyes can detect partial connection of the connectors easily if the slider is stopped a large distance from the proper connection position. However, it is difficult for human eyes to detect an improper connection if the slider is close to the proper connection position.

Moreover, connection resistance created between terminal fittings of both connectors increases if the connectors have many contacts. Thus, it becomes difficult to connect such connectors by hand. Levers typically are used as shown in U.S. Pat. No. 5,401,179 to reduce connecting forces for connector assemblies with many contacts. This connector assembly has a lever rotatably supported on one connector. The lever has arcuate cam grooves that engage cam pins on the other connector. The lever is rotated with the cam grooves and the cam pins engaged to connect the two connectors by cam action. A relatively small operation force on the lever can connect the two connectors easily even if connection resistance between the connectors is large.

Space saving has been required for automotive vehicles in recent years, and a space for installing wiring harnesses and lever-type connectors has become smaller. Thus, sufficient space for rotating the lever may not be available.

Some lever-type connector assemblies (e.g. U.S. Pat. No. 5,401,179) have cam grooves formed in the lever. The cam groove entrances are open in the outer periphery of the lever so that the cam pins can enter the cam grooves. Thus, the outer peripheral portion of the lever at the entrances of the cam grooves is divided or the thickness of outer peripheral portion of the lever at the entrances of the cam grooves is reduced. Consequently, the strength of the outer peripheral portion of the lever is reduced, and there has been a demand for a countermeasure.

The present invention was developed in view of the above problem and an object thereof is to improve an operability of a connector assembly.

SUMMARY OF THE INVENTION

The invention is directed to a connector assembly with first and second connectors that can move along a connecting direction for connection with one another. A slider is mounted on the first connector for linear movement between an initial position and a connection position. The moving direction of the slider is aligned at an angle to the connecting directions of the connectors. The connectors are connected by the cam action of a cam means as the slider is moved from the initial position toward the connection position. The connector assembly also includes a detector that is displaceable between a standby position and a detection position. The detector preferably is on the first connector. A movement detecting means keeps the detector at the standby position before the slider reaches the connection position and permits displacement of the detector to the detection position only after the slider reaches the connection position. Thus, the connector detects whether the slider has been operated properly.

The cam means preferably comprises a cam groove in one of the slider and the second connector and a cam pin on the other. The cam pin extends oblique to both the moving direction of the slider and the connecting directions of the connectors, and is engageable with the cam groove.

The detector can be displaced to the detection position after the slider reaches the proper connection position. However, displacement of the detector to the detection position is prevented when the slider has not reached the proper connection position and the connectors are not connected fully. Thus, the position of the slider can be detected based on whether the detector can be displaced to the detection position.

The slider may have a recess that aligns with and receives the detector when the slider reaches the connection position. The recess is not aligned with the detector before the slider reaches the connection position. Thus, the detector will not move to the detection position until the slider reaches the connection position.

Engagement of the detector in the recess prevents a return movement of the slider. Thus, the slider is locked at the connection position.

The slider preferably has an operable portion that is near the detector when the slider is moved to the connection position. Accordingly, after the operation of the slider, a hand or fingers that were on the operable portion can be transferred to displace the detector without being moved significantly. Thus operational efficiency is good.

The connector assembly also may comprise a lever pivotably provided in or on the first connector. Linking means may be provided for linking the lever and the slider and hence for linking the pivotal movement of the lever with the sliding movement of the slider. A cam groove in one of the lever and the slider is engageable with the cam pin of the second connector to achieve a cam action as the lever is pivoted and/or as the slider is slid.

Accordingly, a pivoting movement applied to the lever causes the connectors to be connected by the cam action of the cam groove and the cam pin and, through the linking means, also causes the sliding movement of the slider. Similarly, a sliding movement applied to the slider causes the connectors to be connected by the cam action of the cam groove and the cam pin and, through the linking means, also causes the rotation of the lever. The user selects the lever or the slider depending on which is easier to operate in view of installation conditions of the connector assembly.

A rotating direction of the lever and a sliding direction of the slider preferably are substantially opposite. Thus, a better selection of the lever or the slider can be made when a great importance is attached to the operating direction of the lever or the slider in view of, for example, space constraints.

The connector assembly may comprise a cam functioning means for connecting the connectors. The cam functioning means comprises a link and the cam groove is formed in the link. The outer periphery of the lever has a projection for engaging the link as the lever is pivoted. Thus, the link is displaced as the lever is pivoted and a cam action of the cam groove and the cam pin is displayed. Therefore, it is not necessary to form the cam groove in the lever and the outer peripheral portion of the lever is strong.

The link may be provided in the first connector or the second connector may be caused to function as a link. In the former case, the cam action is displayed by engaging the cam groove of the link with the cam pin on the second connector. In the latter case, the projection of the lever functions as the cam pin, the cam groove is in the second connector and the projection of the lever and the cam groove of the second connector are engaged.

The link is supported on the first connector to slide in a direction that intersects a connecting direction of the first connector with the second connector, and/or the cam pin is provided on the second connector.

The link engages the projection when the lever is rotated. Thus, the link slides in a direction that intersects the connecting directions of the connectors and the cam groove of the link displays a cam action with the cam pin of the second connector to connect the two connectors.

The link preferably has an engaging portion for engaging the projection so that the projection moves together with the link and is relatively rotatable. The lever also may be supported pivotably on the first connector by the engagement of an oblong hole and a shaft. The rotation of the lever and the sliding movement of the link can be made smoothly because the center of rotation of the lever moves along the oblong hole as the lever is rotated.

The link may include a sliding portion that can be engaged by hand for sliding the link. The connectors are connected by the cam action of the cam groove and the cam pin as the lever is rotated with the engaging portion and the projection engaged. Thus, an operator can select either rotating the lever or sliding the link for connecting the two connectors.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
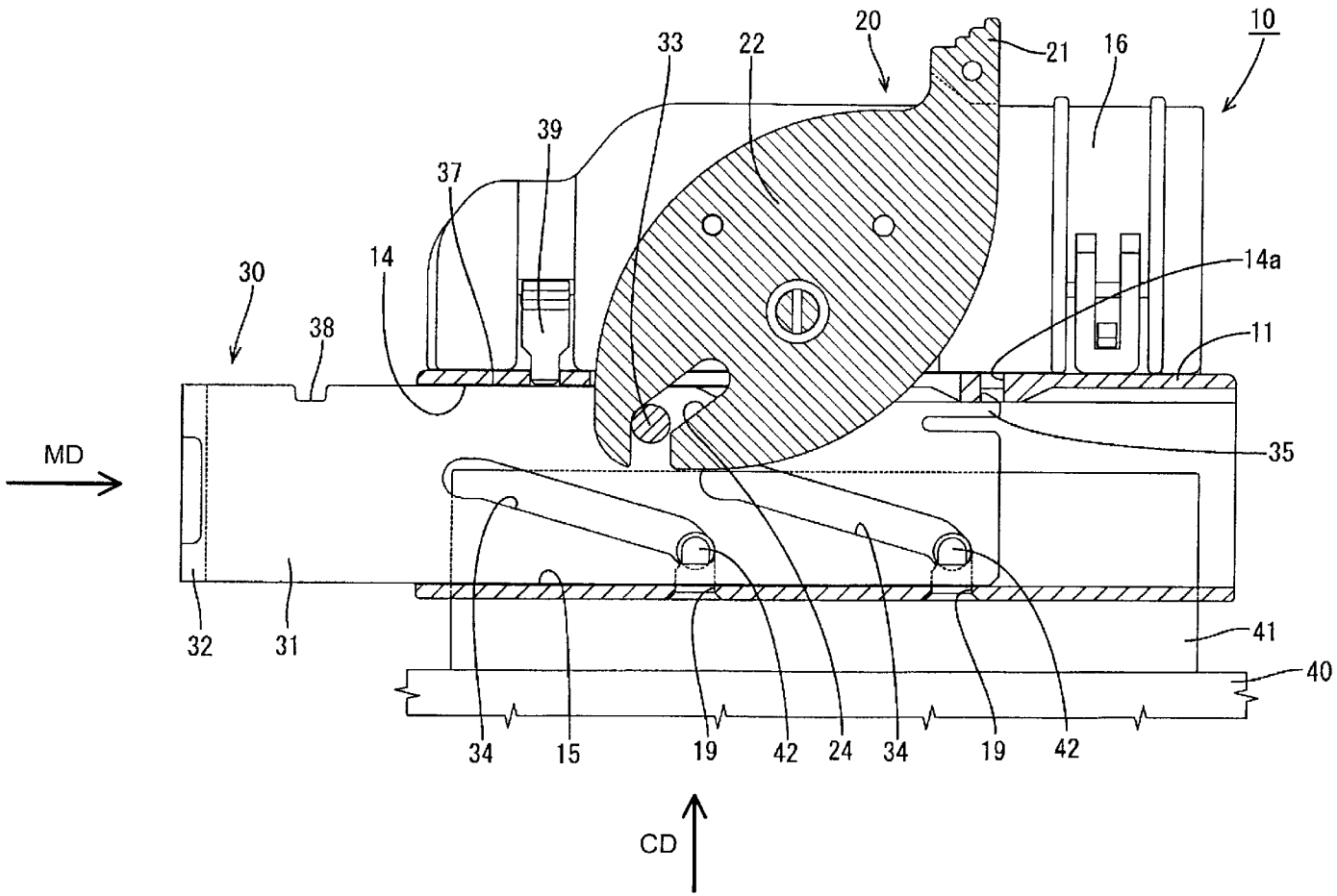
FIG. 1 is a longitudinal section showing a state where a slider is located at an initial position and cam grooves and cam pins are engaged in one embodiment of the invention.
Figure 2:
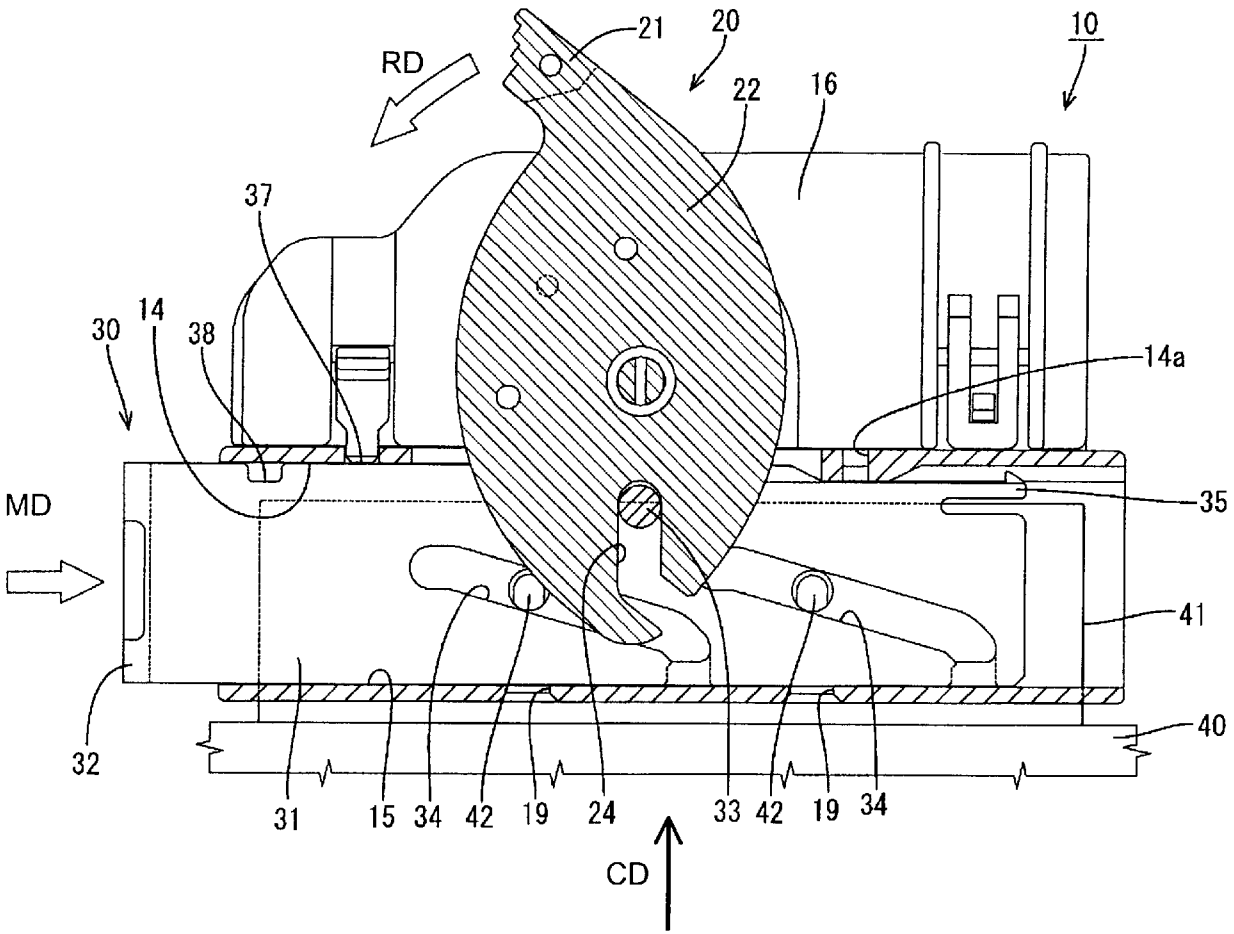
FIG. 2 is a longitudinal section showing an intermediate stage of connection of two connectors as the slider is moved.

A connector assembly according to a first embodiment of the invention is illustrated in FIGS. 1–10. The connector assembly includes a first connector 10 and a second connector 40 that are connectable with one another. The left side of the first connector 10 in FIG. 1 is referred to herein as the front side.

The first connector 10 has a housing 11 formed with cavities 12 and a wire cover 16 that is mountable on the housing 11 from a side opposite the second connector 40. Terminal fittings (not shown) are inserted into the respective cavities 12 from above. Wires (not shown) are connected with the terminal fittings and are drawn out through the upper surface of the first connector 10. The drawn-out wires are bent transversely inside the wire cover 16 and extend back from the wire cover 16. Thus, the wires can be drawn out substantially normal to a connecting direction CD of the connectors 10, 40.

A substantially rectangular engaging hole 13 is formed in the bottom mating surface of the housing 11 and surrounds an area where all the cavities 12 are formed. Left and right guide slits 14 are open in the front and rear ends of the housing 11 and have a long cross section parallel to the longitudinal direction of the housing 11. The guide slits 14 are outside and adjacent the engaging hole 13 and communicate with the engaging hole 13. Left and right lever accommodating grooves 15 open in the upper surface of the housing 11. The lever accommodating grooves 15 are located outside and adjacent to the guide slits 14 and communicate with the guide slits 14.

The connector assembly also includes a lever 20 with an actuator 21 and left and right plate-shaped arms 22 that extend from the actuator 21. The lever 20 is mounted pivotably on or near the wire cover 16. Each arm 22 has a linking groove 24 that extends radially from the outer periphery of the arm 22 toward a center of rotation of the lever 20. The arms 22 are accommodated in the corresponding lever accommodating grooves 15 with the wire cover 16 mounted on the housing 11.

The connector assembly also includes a slider 30 that has left and right elongated movable plates 31 and a plate-shaped operable portion 32 that connects the front ends of the movable plates 31. The movable plates 31 can be inserted into the corresponding guide slits 14 from the front. The slider 30 is linearly movable in a moving direction MD substantially normal to the connecting directions CD of the first and second connectors 10, 40 between an initial position (see FIG. 1) and a connection position (see FIG. 4).

Each movable plate 31 of the slider 30 has front and rear cam grooves 34 that extend oblique to both the moving direction MD of the slider 30 and the connecting directions CD of the connectors 10, 40. The cam grooves 34 slope up to the front in a direction opposite to the moving direction MD. Rear ends of the cam grooves 34 define open entrances at the bottom edges of the movable plates 31. A resilient lock 35 is formed at the rear-upper corner of each movable plate 31, and the slider 30 can be held at the initial position by engaging the resilient locks 35 with locks 14*a* at the upper walls of the guide slits 14.

The operable portion 32 is spaced forward from the front surface of the housing 11 when the slider 30 is at the initial position, but substantially contacts the front surface of the housing 11 when the slider 30 is at the connection position. Further, the entrances of the cam grooves 34 substantially align with guide holes 19 in the bottom surface of the housing 11 through the bottom walls of the guide slits 14 when the slider 30 is at the initial position.

A displacement preventing edge 37 extends substantially parallel with the moving direction MD of the slider 30 along the top of each movable plate 31 from the front end to a middle position. Each movable plate 31 also has a recess 38 on the displacement preventing edge 37 near the operable portion 32. A linking pin 33 projects from each movable plate 31 for engagement with the linking groove 24 of the lever 20.

Figure 3:
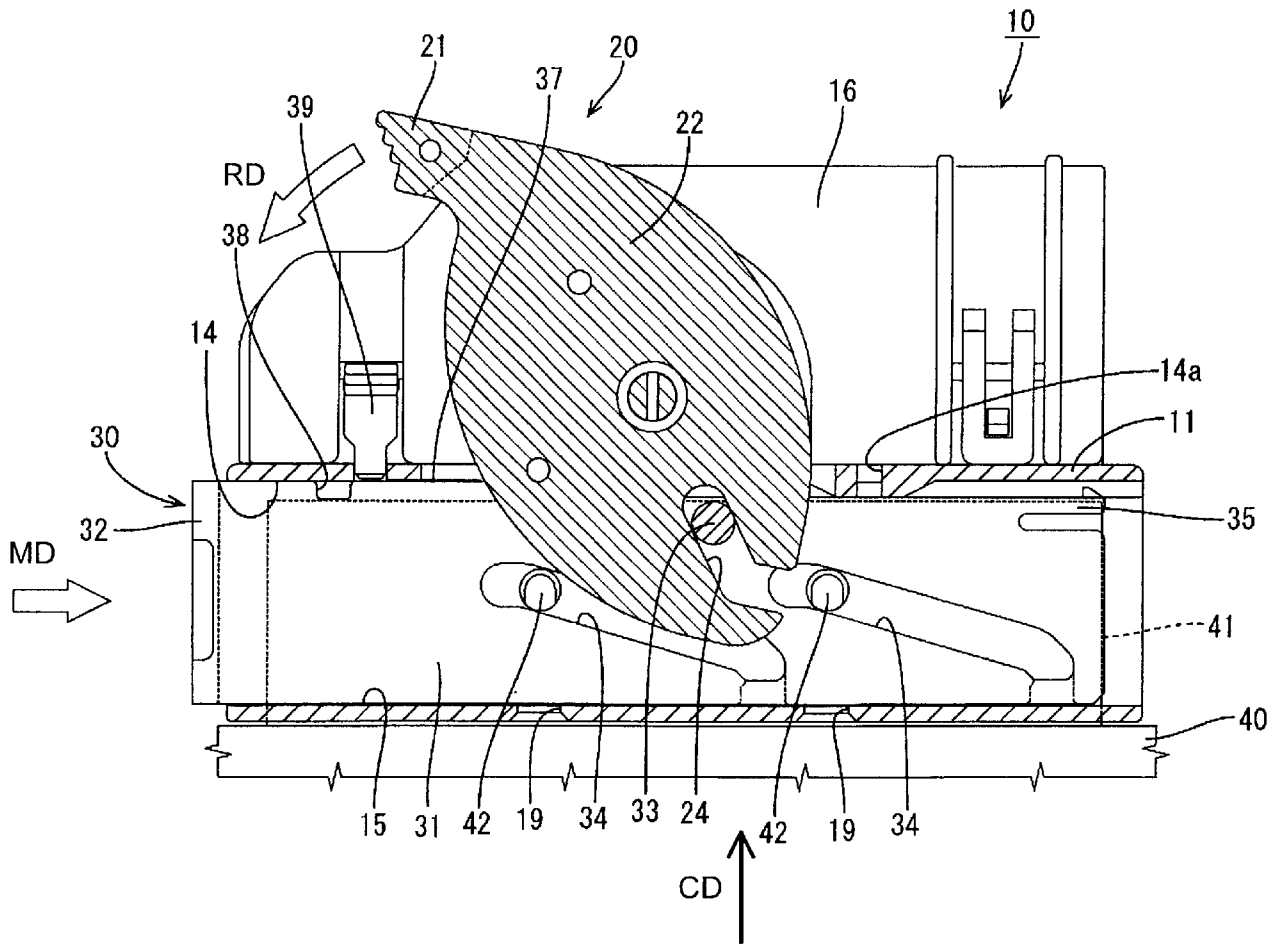
FIG. 3 is a longitudinal section showing a partly connected state of the connectors with the slider immediately before a proper connection position.
Figure 4:
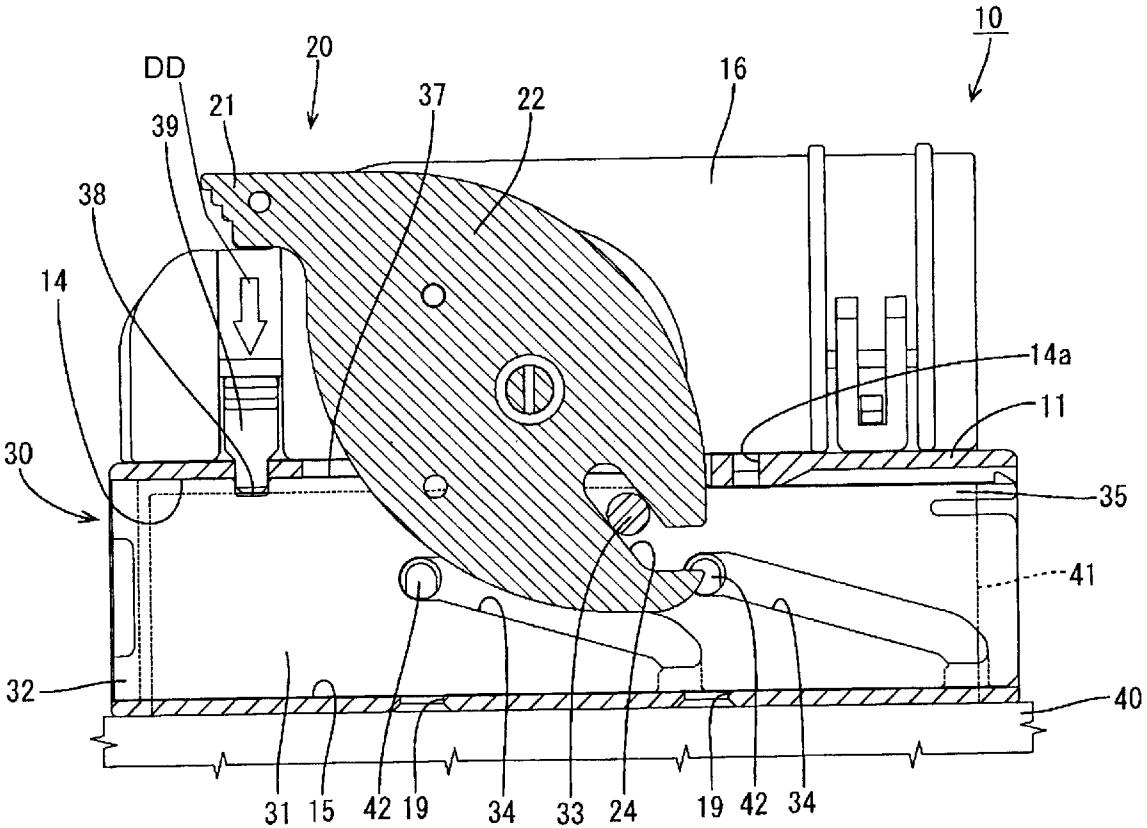
FIG. 4 is a longitudinal section showing a state where the slider is at the proper connection position and a detector is at a detection position.
Figure 5:
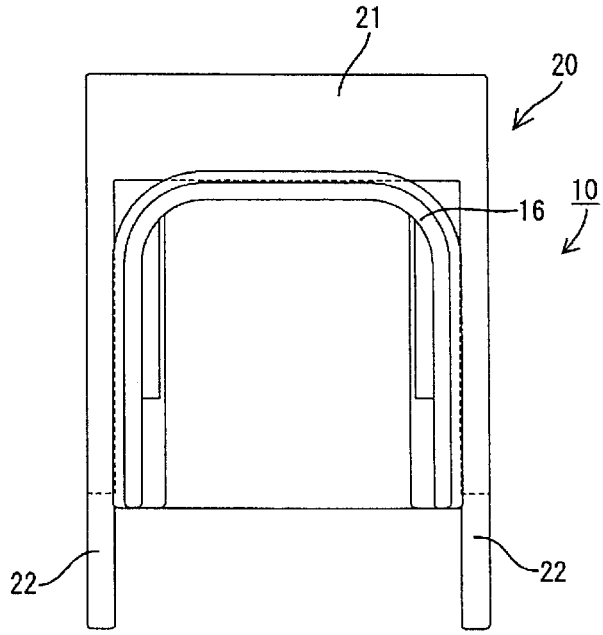
FIG. 5 is a rear view of a wire cover and a lever.
Figure 6:
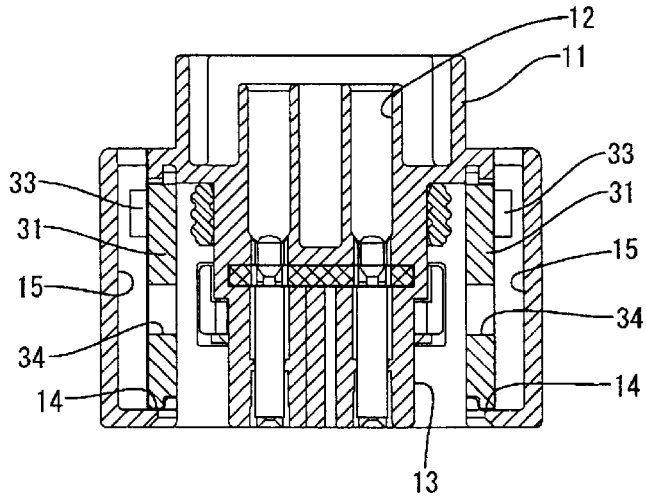
FIG. 6 is a lateral section of a housing.
Figure 7:
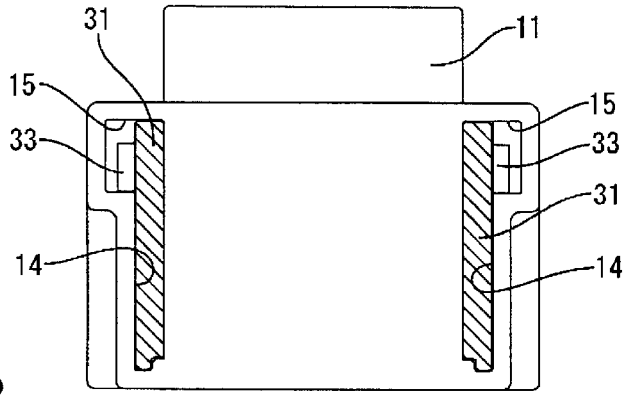
FIG. 7 is a front view of the housing.
Figure 8:
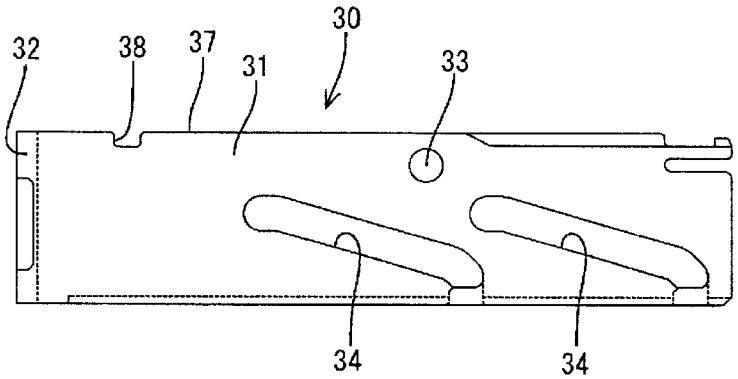
FIG. 8 is a side view of the slider.
Figure 9:
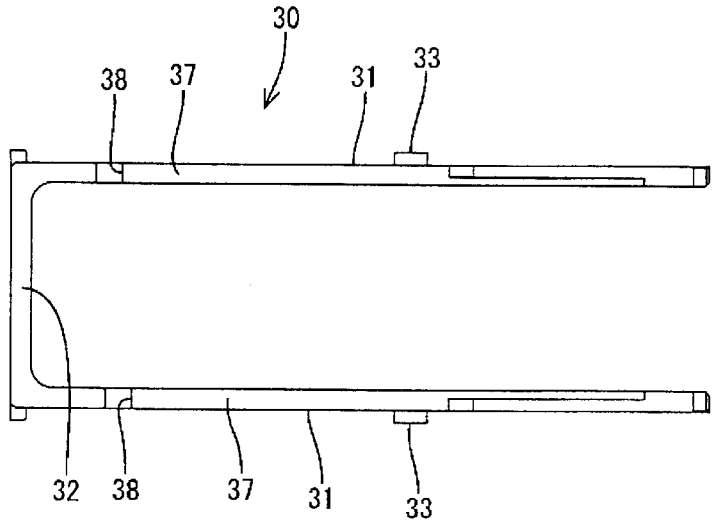
FIG. 9 is a plan view of the slider.
Figure 10:
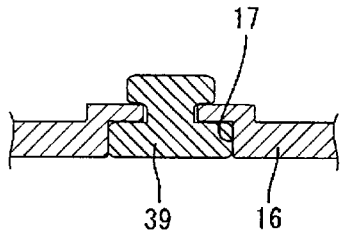
FIG. 10 is a partial enlarged section of a structure for supporting the detector.

Detectors 39 are provided on the wire cover 16 above the slider 30 and are moveable vertically substantially normal to the moving direction MD of the slider 30. The detectors 39 are guided by guide grooves 17 in the wire cover 16 between a standby position (see FIGS. 1 to 3) and a detection position (see FIG. 4) below the standby position. The detectors 39 are near the front end of the wire cover 16 and hence are near the operable portion 32 when the slider 30 is at the connection position (FIG. 4). Bottom surfaces of the detectors 39 are at the same height as or slightly above the movement preventing edges 37 of the slider 30 when the detectors 39 are at the standby position. The bottom ends of the detectors 39 are dimensioned to fit into the recesses 38 of the slider 30 without forward and backward shaking.

The second connector 40 has a substantially rectangular tubular receptacle 41 that opens up along the connecting direction CD. The receptacle 41 is fittable from below into the engaging hole 13 of the first connector 10. Front and rear cam pins 42 project out on each of the opposite side walls of the receptacle 41. The cam pins 42 enter the guide holes 19 of the first connector 10 as the receptacle 41 is fitted into the engaging hole 13.

The two connectors 10, 40 are assembled by first positioning the lever 20 at the initial position (FIG. 1) on the wire cover 16 so that the entrances of the linking grooves 24 of the arms 22 to face down and in the mounting direction of the wire cover 16 on the housing 11. The slider 30 is held at the initial position in the housing 11, and the detecting members 39 are held at the standby position in the wire cover 16.

The wire cover 16 then is mounted on the housing 11 so that the arms 22 fit into the lever accommodating grooves 15, and the entrances of the linking grooves 24 engage the linking pins 33 of the slider 30 (see FIG. 1). At this time, each detector 39 faces a position on the movement preventing edge 37 of the slider 30 behind the recess 38. Thereafter, the receptacle 41 of the second connector 40 fits in the engaging hole 13 from below, and the cam pins 42 pass through the guide holes 19 to enter the cam grooves 34 of the slider 30.

The slider 30 then is moved in the moving direction MD from the initial position toward the connection position (see FIG. 2) by manually pushing on the operable portion 32 of the slider 30. As a result, the cam grooves 34 and the cam pins 42 display a cam action that pulls the connectors 10, 40 toward each other along the connecting direction CD for proper connection.

The recesses 38 are right below the detectors 39, as shown in FIG. 4, when the slider 30 is pushed to the proper connection position. Thus, the detectors 39 at the standby position can be displaced down in a displacement direction DD toward the detection position. The displacement direction DD is substantially normal to the moving direction MD of the slider 30. Further, the operable portion 32 of the slider 30 is near the detectors 39 of the wire cover 16. Thus, the hand or fingers need only be moved slightly obliquely up and the back from the operable portion 32 to the detectors 39 to push the detectors 39 in the displacement direction DD towards the detection position. The downward pushing of the detectors 39 in the displacement direction DD fits the bottom ends of the detectors 39 fit into the recesses 38 without shaking along the moving direction MD of the slider 30. Thus, the slider 30 is locked and prevented from moving loosely along the moving direction MD toward the initial position. Locking the slider 30 at the connection position locks the two connectors 10, 40 in their properly connected state.

The connectors 10, 40 are left only partly connected if the slider 30 is not pushed fully to the proper connection position. In this partly connected state, the recesses 38 are displaced forward of the detectors 39 along the moving direction MD, as shown in FIG. 3. Therefore, the movement preventing edges 37 interfere with the bottom ends of the detectors 39, and the detectors 39 cannot be pushed down to the detection position. Accordingly, the recesses 38 align with the detectors 39 only when the slider 30 is in the connection position (FIG. 4), and hence the detectors 39 can be displaced to the detecting position only when the slider 30 is in the connection position (FIG. 4).

The slider 30 may be difficult to operate in some installations of the connector assembly. However, the lever 20 may be used as an operable means. Specifically, a hand or fingers may be placed on the actuator 21 of the lever 20 to displace the actuator 21 forward above the wire cover 16. The lever 20 then is pivoted to the connection position and the inner walls of the linking grooves 24 push the linking pins 33. Thus, the slider 30 is slid from the initial position toward the connection position. In this case as well, the cam action is displayed by the engagement of the cam grooves 34 and the cam pins 42 as the slider 30 is moved to connect the two connectors 10, 40.

As described above, the detectors 39 can be displaced from the standby position to the detection position after the slider 30 reaches the proper connection position. However, displacement of the detectors 39 from the standby position to the detection position is prevented even when the slider 30 is immediately before the proper connection position and when the connectors 10, 40 are connected only partly. Thus, the position of the slider 30 or the connected state of the connectors 10, 40 can be detected based on whether the detectors 39 can be displaced to the detection position.

The slider 30 has its return movement toward the initial position prevented by engaging the detectors 39 in the recesses 38 after the slider 30 is at the proper connection position. In this way, the detectors 39 and the recesses 38 detect the position of the slider 30 and also lock the slider 30 at the connection position. Hence, it is not necessary to have special means for locking the slider 30 at the connection position.

The operable portion 32 of the slider 30 is near the detectors 39 when the slider 30 is in the connection position. Accordingly, the hand or fingers that were on the operable portion 32 to move the slider 30 can be transferred easily to the detectors 39. Thus, operational efficiency is good.

Figure 11:
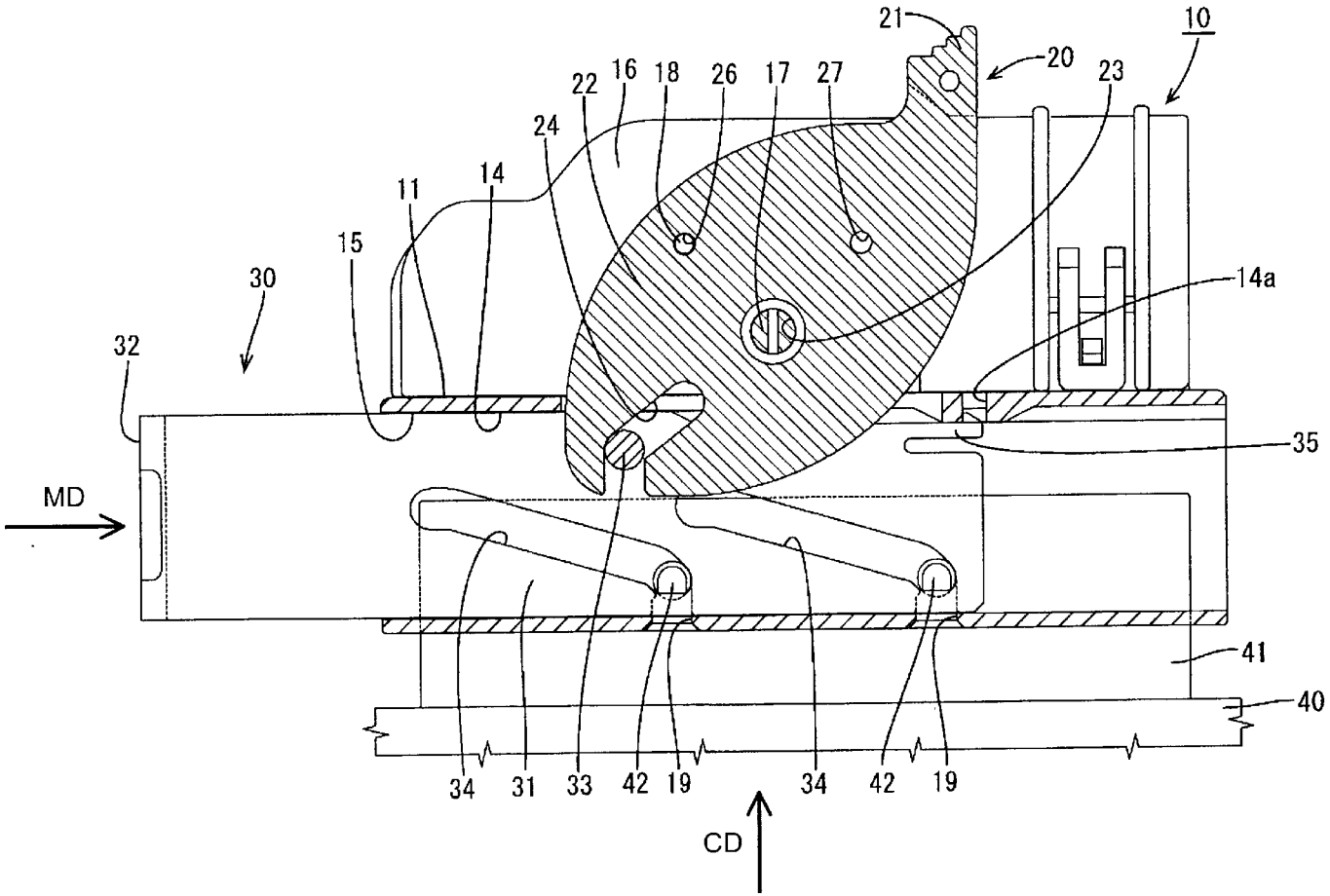
FIG. 11 is a longitudinal section showing a state where a lever and a slider are located at their initial positions in a further embodiment.
Figure 12:
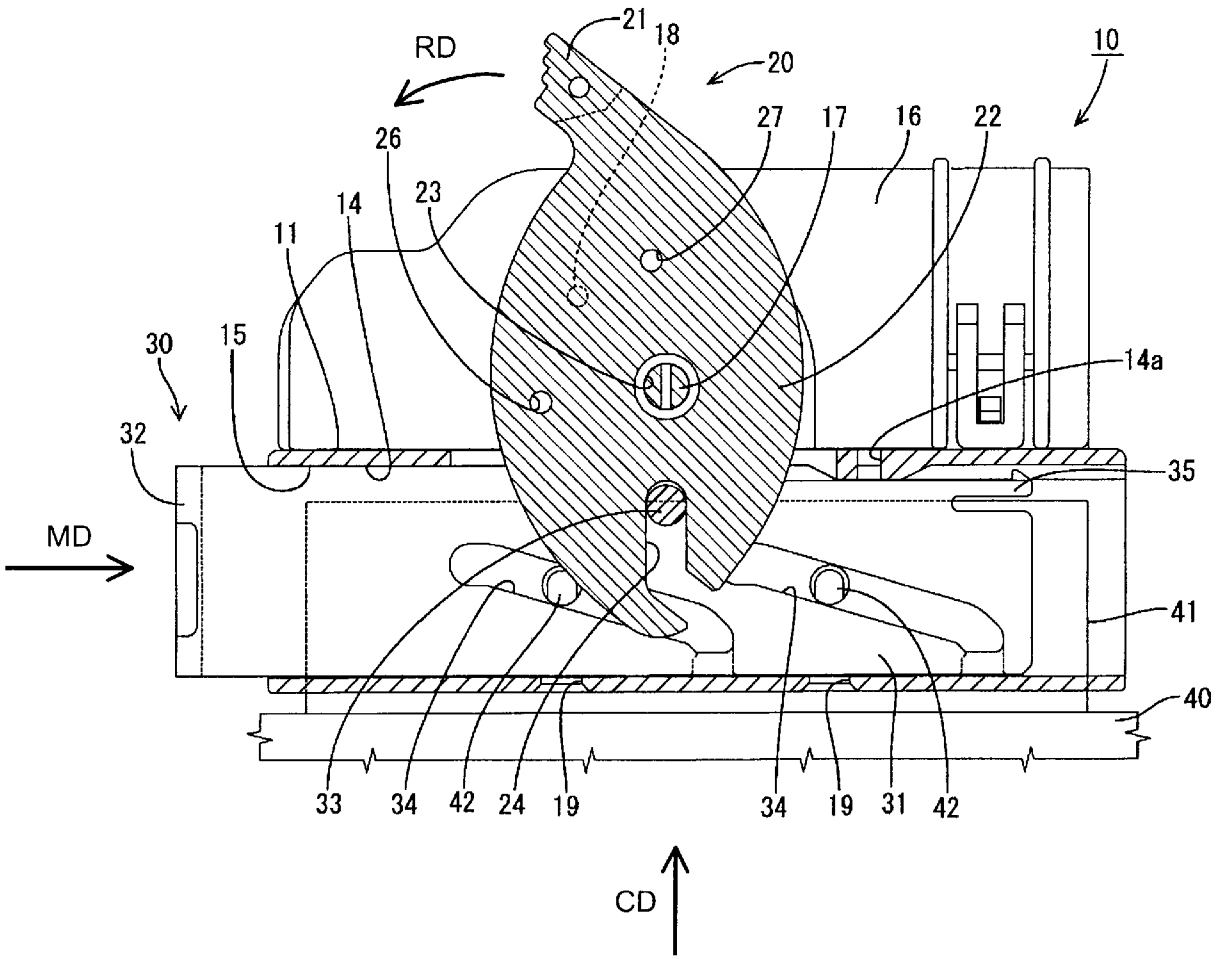
FIG. 12 is a longitudinal section showing an intermediate stage of displacements of the lever and the sliders from their initial positions toward their connection positions.
Figure 13:
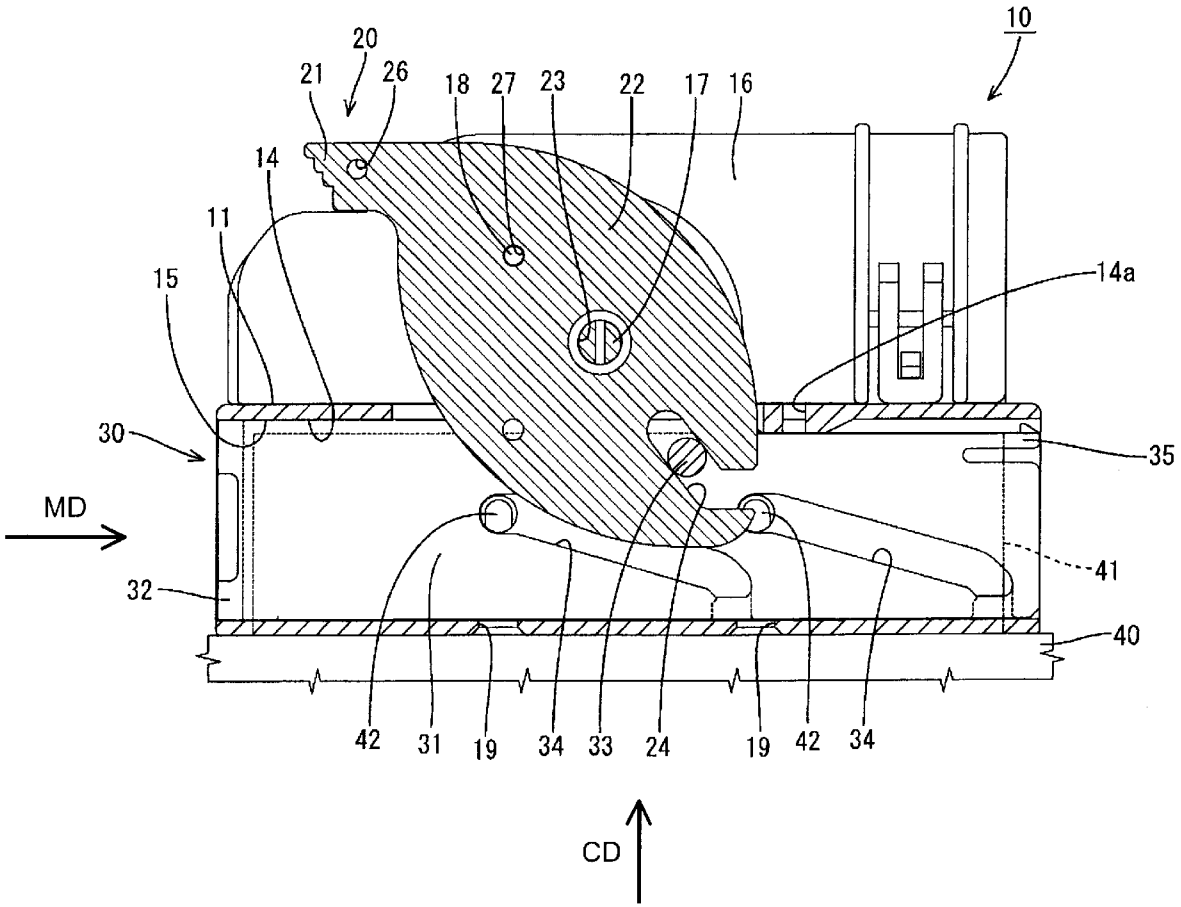
FIG. 13 is a longitudinal section showing a state where the lever and the slider are located at their connection positions.
Figure 14:
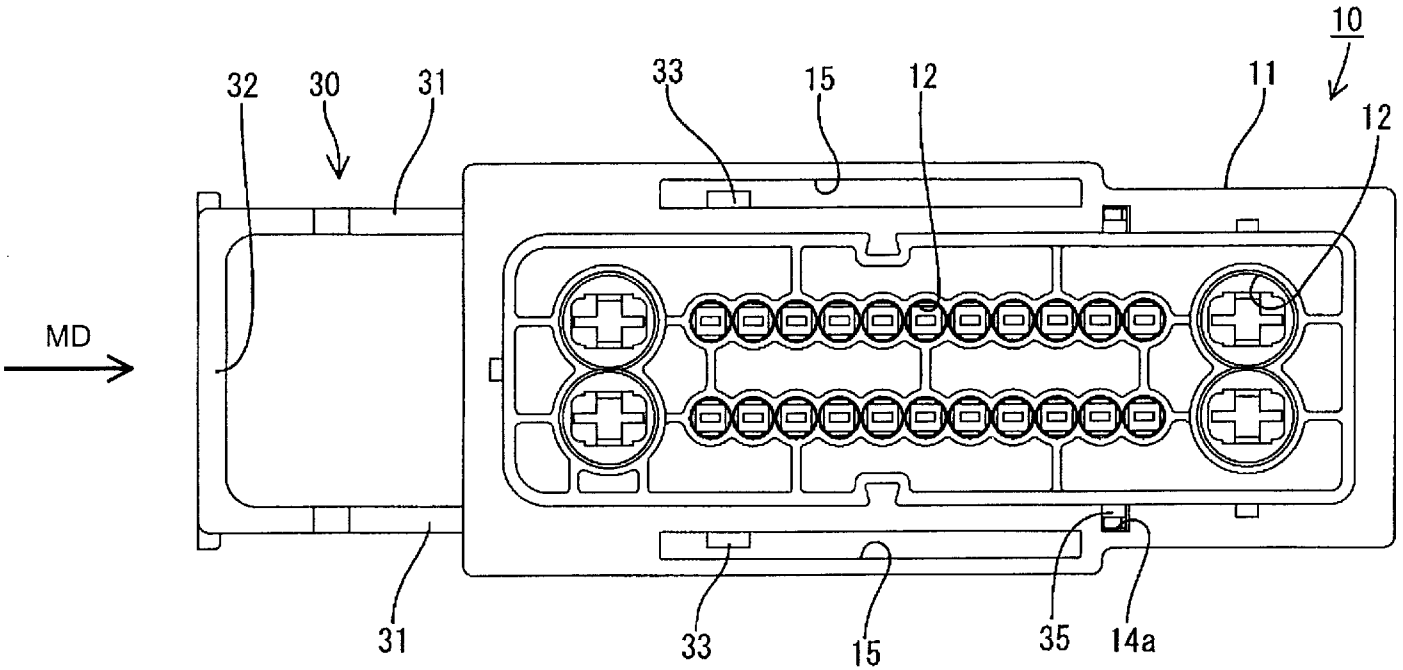
FIG. 14 is a plan view of a first connector.
Figure 15:
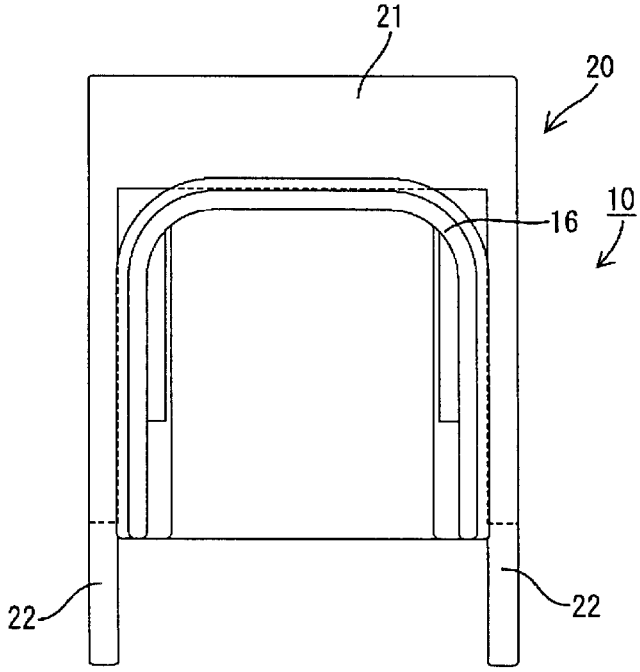
FIG. 15 is a rear view of a wire cover and the lever.
Figure 16:
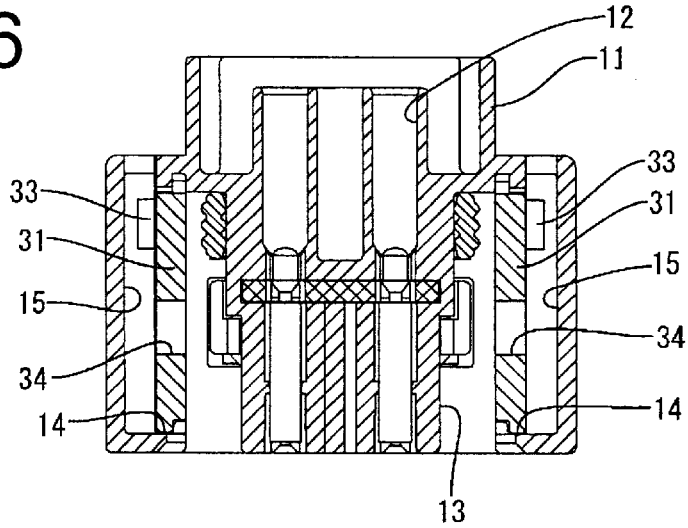
FIG. 16 is a lateral section of a housing.
Figure 17:
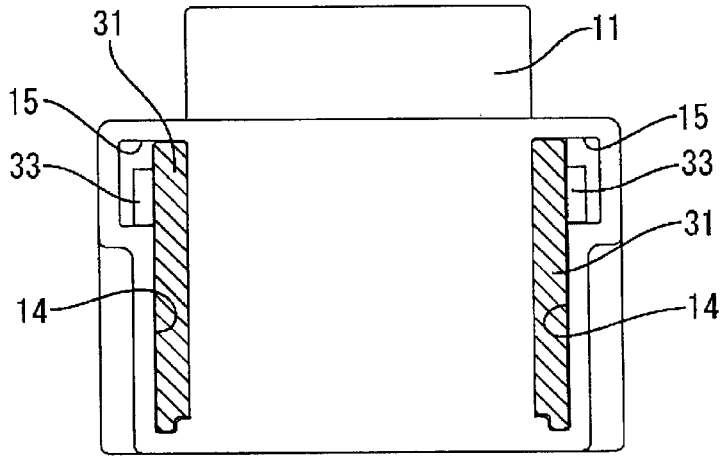
FIG. 17 is a front view of the housing.

A connector assembly according to a second embodiment is shown in FIGS. 11 to 17, and is comprised of a first connector 10 and a second connector 40 that are connectable with and separable from each other. In the following description, left side in FIG. 11 is referred to as the front side.

The first connector 10 has a housing 11 with cavities 12 inside, and a wire cover 16 is mountable on the housing 11 from a side opposite the mating side with the second connector 40. Terminal fittings (not shown) are inserted into the cavities 12 from above, and wires (not shown) connected with the terminal fittings are drawn out through the upper surface of the first connector 10. The drawn-out wires are bent transversely inside the wire cover 16 to extend back (rightward in FIG. 11) from the wire cover 16.

A substantially rectangular engaging hole 13 is formed in the bottom mating surface of the housing 11 and surrounds an area where all the cavities 12 are formed. Left and right guide slits 14 are open in the front and rear ends of the housing 11 and have a long cross section parallel to the longitudinal direction of the housing 11. The guide slits 14 are outside and adjacent the engaging hole 13 and communicate with the engaging hole 13. Left and right lever accommodating grooves 15 open in the upper surface of the housing 11. The lever accommodating grooves 15 are located outside and adjacent to the guide slits 14 and communicate with the guide slits 14.

The connector assembly also includes a lever 20 with an actuator 21 and left and right plate-shaped arms 22 that extend from the actuator 21. The lever 20 is mounted rotatably on the wire cover 16 by engaging bearing holes in the arms 22 with supporting shafts 17 of the wire cover 16. Each arm 22 is formed with a linking groove or recess 24 that extends radially from the outer periphery of the arm 22 toward a center of rotation of the lever 20. The longitudinal direction of the linking grooves 24 intersects with a rotating direction RD of the lever 20 and, at the same time, intersects with a moving direction MD of the slider 30 regardless of the position at which the lever 20 is located between an initial position and a connection position. Thus, the linking grooves 24 have a radial component with respect to the bearing hole 23 and the supporting shaft 17 and gradually approach the bearing hole 23 and the supporting shaft 17. The arms 22 are accommodated in the corresponding lever accommodating grooves 15 with the wire cover 16 mounted on the housing 11.

Each arm 22 is formed with an initial position locking hole 26 and a connection position locking hole 27. The lever 20 can be held at the initial position (see FIG. 11) where the entrances of the linking grooves 24 face down toward a mating side with the second connector 40 by engaging the initial position holding holes 26 with locking projections 18 on the wire cover 16. Further, the lever 20 can be held at the connection position (see FIG. 13) where the actuator 21 is at the front end of the lever 20 by engaging the connection position locking holes 27 with the locking projections 18.

The connector assembly also includes a slider 30 with elongated left and right movable plates 31 that have their front ends connected by a plate-shaped sliding portion 32. The movable plates 31 are inserted into the corresponding guide slits 14 from the front. The slider 30 can be slid linearly in forward and backward movable directions MD substantially normal to connecting directions CD of the first and second connectors 10, 40 between an initial position (see FIG. 11) and a connection position (see FIG. 13) while sliding the movable plates 31 inside the guide slits 14. A round linking pin 33 is formed on the outer surface of each movable plate 31 of the slider 30, and projects into the corresponding lever accommodating groove 15.

Each movable plate 31 of the slider 30 has front and rear cam grooves 34 that extend oblique to both the moving direction MD of the slider 30 and the connecting directions CD of the two connectors 10, 40. The cam grooves 34 are sloped up to the front in a direction opposite to the moving direction MD and in a connection direction CD, and the rear ends of the cam grooves 34 define open entrances at the bottom edges of the movable plates 31. A resilient lock 35 is formed at the rear-upper corner of each movable plate 31, and the slider 30 can be held at the initial position by engaging the resilient locks 35 with locks 14*a* at the upper walls of the guide slits 14. The sliding portion 32 is spaced forward from the front end of the housing 11 when the slider 30 is at the initial position. Further, the entrances of the cam grooves 34 align with guide holes 19 in the bottom surface of the housing 11 through the bottom walls of the guide slits 14 when the slider 30 is at the initial position.

The second connector 40 has a substantially rectangular tubular receptacle 41 that opens up along the connecting direction CD. The receptacle 41 is fittable from below into the engaging hole 13 of the first connector 10. Front and rear cam pins 42 project out on each of the opposite side walls of the receptacle 41. The cam pins 42 enter the guide holes 19 of the first connector 10 as the receptacle 41 is fitted into the engaging hole 13.

The two connectors 10, 40 are assembled by first holding the lever 20 at the initial position on the wire cover 16. Thus, entrances of the linking grooves 24 of the arms 22 face down in the mounting direction of the wire cover 16 on the housing 11. The slider 30 also is held at the initial position.

The wire cover 16 then is mounted on the housing 11 in this state so that the arms 22 fit into the lever accommodating grooves 15, and the entrances of the linking grooves 24 engage the linking pins 33 of the slider 30 (see FIG. 11). Thereafter, the receptacle 41 of the second connector 40 is inserted in the connecting direction CD into the engaging hole 13 and the cam pins 42 pass through the guide holes 19 to enter the cam grooves 34 of the slider 30 (see FIG. 11).

Thereafter, the lever 20 and the slider 30 are moved from their initial positions toward their connection positions. Thus, the connectors 10, 40 are pulled toward each other for proper connection by the cam action of the engaged cam grooves 34 and cam pins 42. Either one of the lever 20 or the slider 30 can be selected as a means for generating the cam action.

Specifically, the lever 20 can be used as the operable means by placing a hand, fingers or a tool on the actuator 21 of the lever 20 to displace the actuator 21 forward in the rotating direction RD, over the wire cover 16, and towards the connection position. The inner walls of the linking grooves 24 push the linking pins 33 as the lever 20 is rotated so that the slider 30 slides in the moving direction MD towards the connection position while being linked with the rotation of the lever 20, and the cam action is displayed by the cam grooves 34 and the cam pins 42 as the slider 30 is moved.

The slider 30 can be used as the operable means by placing a hand or fingers on the sliding portion 32 to slide the slider 30 in the moving direction MD back toward the housing and to the connection position. The cam action is displayed by the engagement of the cam grooves 34 and the cam pins 42 as the slider 30 is moved. The linear movement of the slider 30 causes the linking pins 33 to push the inner walls of the linking grooves 24. Thus, the lever 20 is rotated from the initial position to the connection position while being linked with the movement of the slider 30.

As described above, according to this embodiment, the rotatable lever 20 and/or the slidable slider 30 are provided as the operable members for connecting the two connectors 10, 40, and the cam action is displayed by suitably linking these two operable members with each other by the linking means 24, 33. Thus, one of the lever 20 and the slider 30 can be selected depending on installation conditions of the connector assembly and ease of operation, thereby presenting good operability.

The actuator 21 is displaced in the forward rotating direction RD when the lever 20 is operated for connection. Alternatively, the sliding portion 32 is displaced in the rearward moving direction MD when the slider 30 is operated for connection. Thus, the operating directions of the actuator 21 of the lever 20 and of the sliding portion 32 of the slider 30 are substantially opposite. Accordingly, a better selection can be made when a great importance is attached to the operating direction of the lever 20 or the slider 30.

Figure 18:
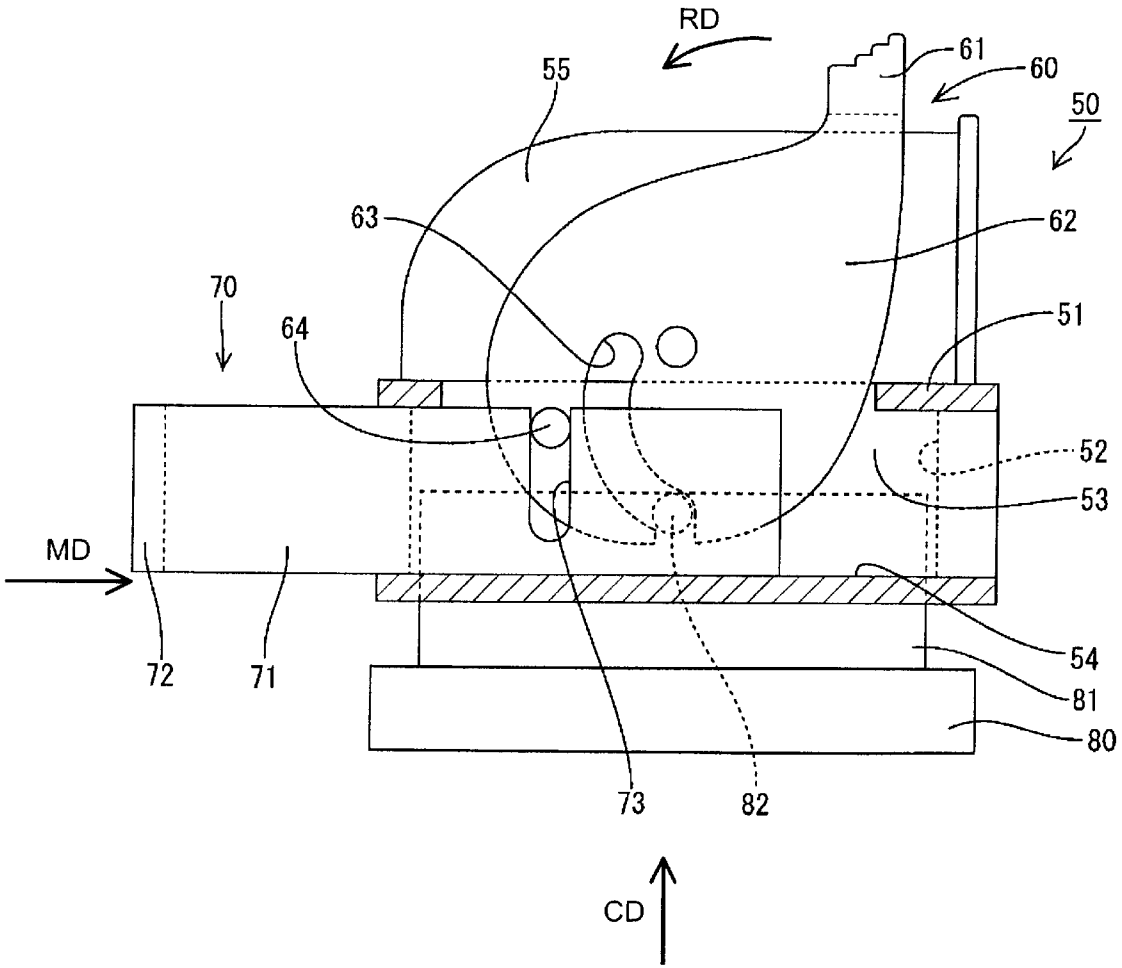
FIG. 18 is a section of another embodiment.

A third embodiment of the invention is described with reference to FIG. 18. In the third embodiment, cam grooves 63 are formed in a lever 60 rather than in the slider. Other elements are similar to the previous embodiment, and no description is given for those elements that are the same or similar to the previous embodiments.

The third embodiment includes a first connector 50 with a housing 51 and a substantially rectangular engaging hole 52 that opens in the bottom surface of the housing 51. Left and right lever accommodating grooves 53 are outside and adjacent to the engaging hole 52 and communicate with the engaging hole 52. Left and right guide slits 54 are outside and adjacent to the lever accommodating grooves 53 and communicate with the lever accommodating grooves 53. An arcuate cam groove 63 is formed in each arm 62 of the lever 60, and a linking pin 64 projects from the outer surface of each arm 62. A vertically extending linking groove 73 is formed in each movable plate 71 of a slider 70 and opens in the upper edge facing toward the lever 60 of the movable plate 71. The longitudinal direction of the linking grooves 73 is substantially normal to a moving direction MD of the slider 70 and intersects with an arcuate trace of displacement of the linking pins 64 that accompany the rotation of the lever 60 between the initial position and the connection position.

The connectors 50, 80 are connected by first supporting the lever 60 at the initial position on a wire cover 55 so that entrances of the cam grooves 63 face down. On the other hand, linking grooves 73 in the housing 51 align with the linking pins 64 of the lever 60 when the slider 70 is at the initial position.

The wire cover 55 then is mounted on the housing 51 in this state so that the arms 62 fit into the lever accommodating grooves 53 and the linking pins 64 enter the linking grooves 73. Thereafter, a receptacle 81 of the second connector 80 is fitted into the engaging hole 52 from below and the cam pins 82 enter the cam grooves 63 of the lever 60.

The lever 60 or the slider 70 then is moved from the initial position toward the connection positions. As a result, the two connectors 50, 80 are connected with each along the connecting direction CD other by the cam action of the cam grooves 63 and the cam pins 82. Here, either one of the lever 60 and the slider 70 can be selected as a means for displaying the cam action.

If the lever 60 is selected as the operable means, a hand or fingers are placed on an actuator 61 of the lever 60 to displace the actuator 61 forward in the rotating direction RD to rotating the lever 60 towards the connection position. Thus, the cam grooves 63 and the cam pins 82 display the cam action as the lever 60 is rotated. Further, the linking pins 64 push the inner walls of the linking grooves 73 as the lever 60 is rotated. As a result, the slider 70 is slid from the initial position to the connection position while being linked with the rotation of the lever 60.

If the slider 70 is selected as the operable means, a hand or fingers are placed on a sliding portion 72 to push the slider 70 back in the moving direction MD toward both the housing 51 and the connection position. As the slider 70 is moved linearly, the inner walls of the linking grooves 73 push the linking pins 64. Thus, the lever 60 is rotated from the initial position towards the connection position. The cam action is displayed by the cam grooves 63 and the cam pins 82 as the lever 60 is rotated.

Figure 19:
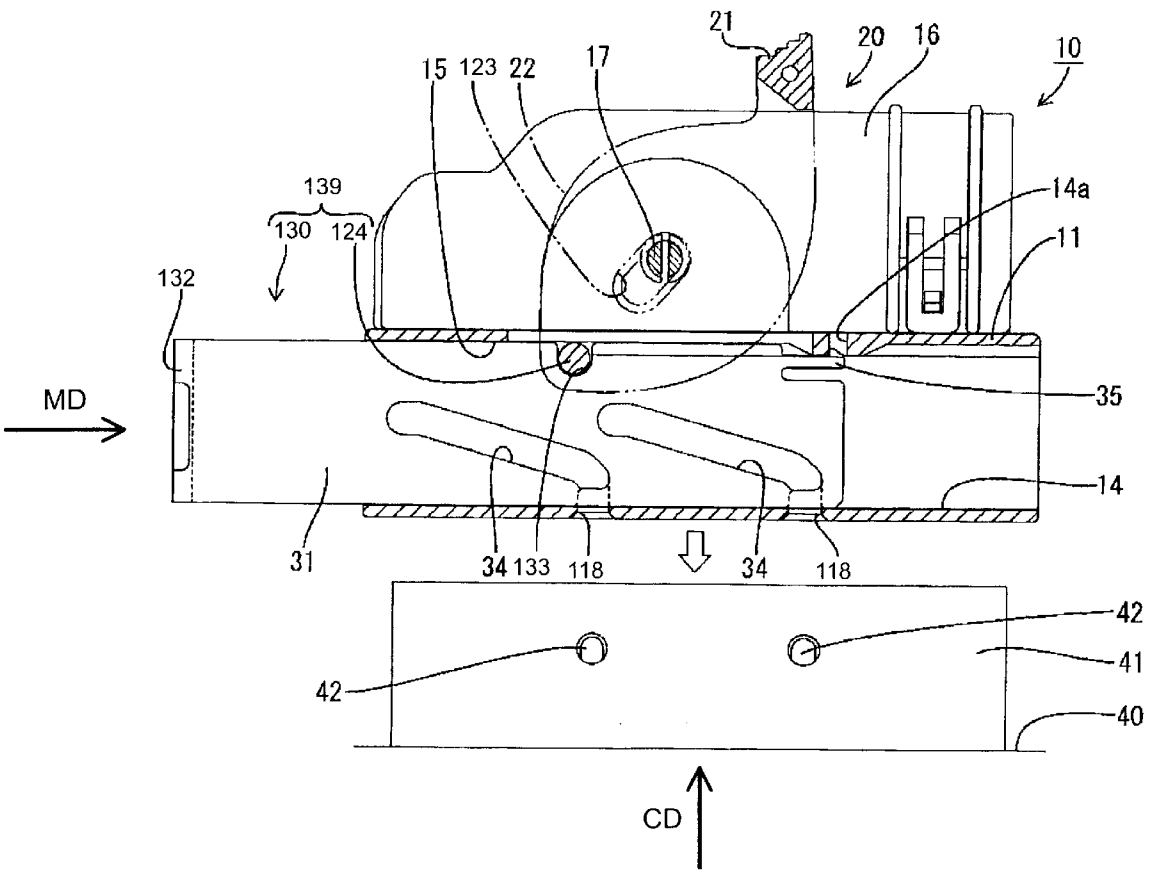
FIG. 19 is a side view partly in section showing a state where a first connector and a second connector are separated in one further embodiment of the invention.
Figure 20:
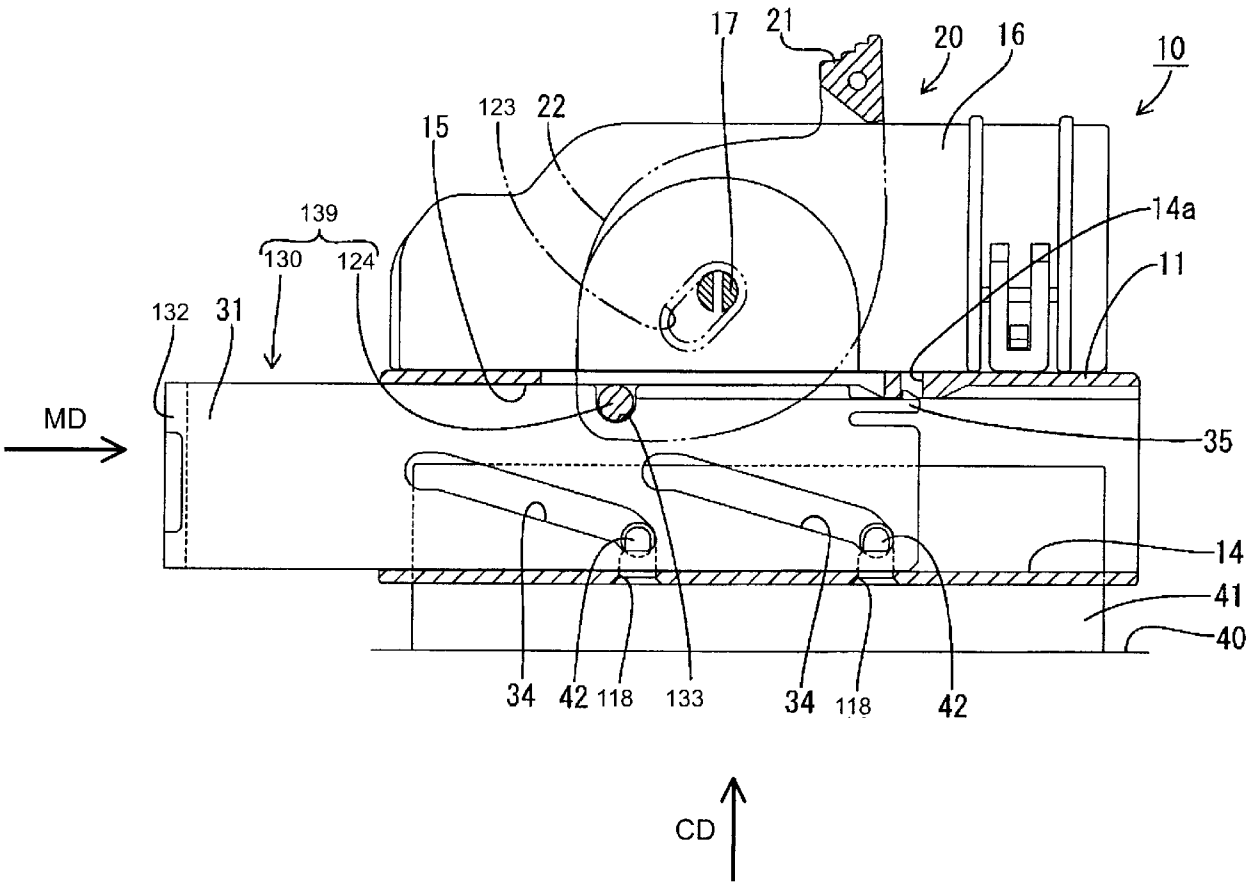
FIG. 20 is a side view in section showing a state where cam grooves and cam pins are engaged.

A connector assembly according to a fourth embodiment of the invention includes first and second connectors 10 and 40, as shown in FIGS. 19 to 20. In the following description, left side in FIG. 19 is referred to as front side concerning forward and backward directions.

The first connector 10 has a housing 11 with cavities 12 and a wire cover 16 mountable on the housing 11 from above, which is the side opposite to the mating side of the second connector 40. Terminal fittings (not shown) are inserted into the respective cavities 12 from above, and wires (not shown) connected with the terminal fittings are drawn out through the upper surface of the first connector 10. The drawn-out wires are bent substantially normal to the terminal fittings inside the wire cover 16 so that the bent wires extend substantially back from the wire cover 16 (rightward in FIG. 19).

A rectangular engaging hole 13 is formed on the bottom of the housing 11 and surrounds an area where the cavities 12 are formed. A receptacle 41 of the second connector 40 is insertable into the engaging hole 13 from below in a connecting direction CD. Left and right guide slits 14 are formed inside the housing 11. The guide slits 14 open in the front and rear ends of the housing 11 and having a long cross section along the connecting direction CD of the housing 11. The guide slits 14 are outside and adjacent to the engaging hole 13 and communicate with the engaging hole 13. Left and right lever accommodating grooves 15 are open in the upper surface of the housing 11. The lever accommodating grooves 15 are adjacent to the guide slits 14 and communicate with the guide slits 14.

The connector assembly also has a lever 20 with left and right plate-shaped arms 22 that extend from a rotating portion 21. The lever 20 is mounted on the wire cover 16 for rotation by engaging oblong holes 123 substantially in the centers of the arms 22 with round shafts 17 on the wire cover 16. A substantially round projection 124 projecting at a position near the outer periphery of the inner surface of each arm 22. The arms 22 are partly accommodated in the corresponding lever accommodating grooves 15 and the projections 124 of the lever 20 are positioned in the guide slits 14 when the wire cover 16 is mounted on the housing 11. The oblong holes 123 of the arms 22 extend substantially parallel with a line connecting substantially center positions of the arms 22 with the projections 124.

Figure 22:
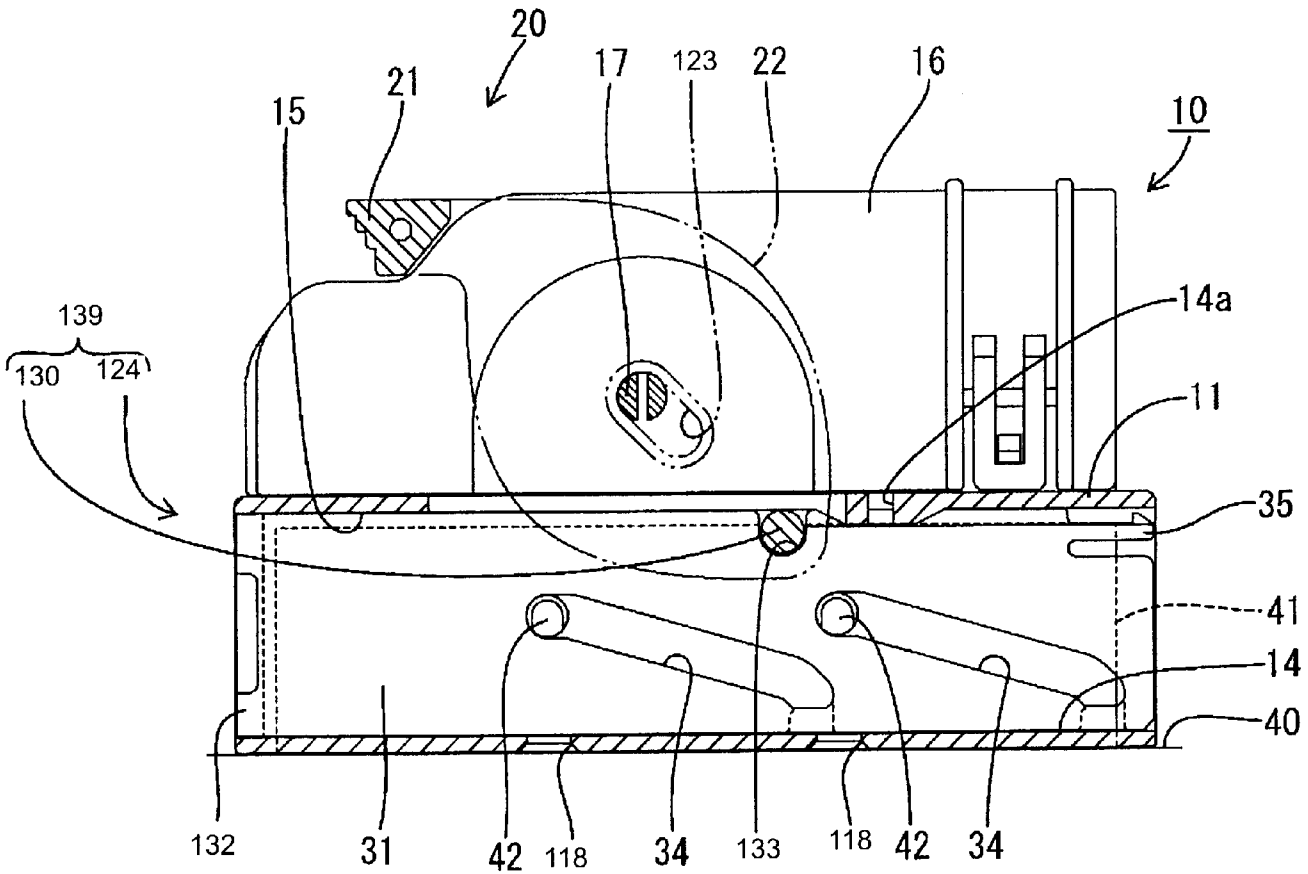
FIG. 22 is a side view in section showing a state where the two connectors are connected upon completing the rotation of the lever.
Figure 23:
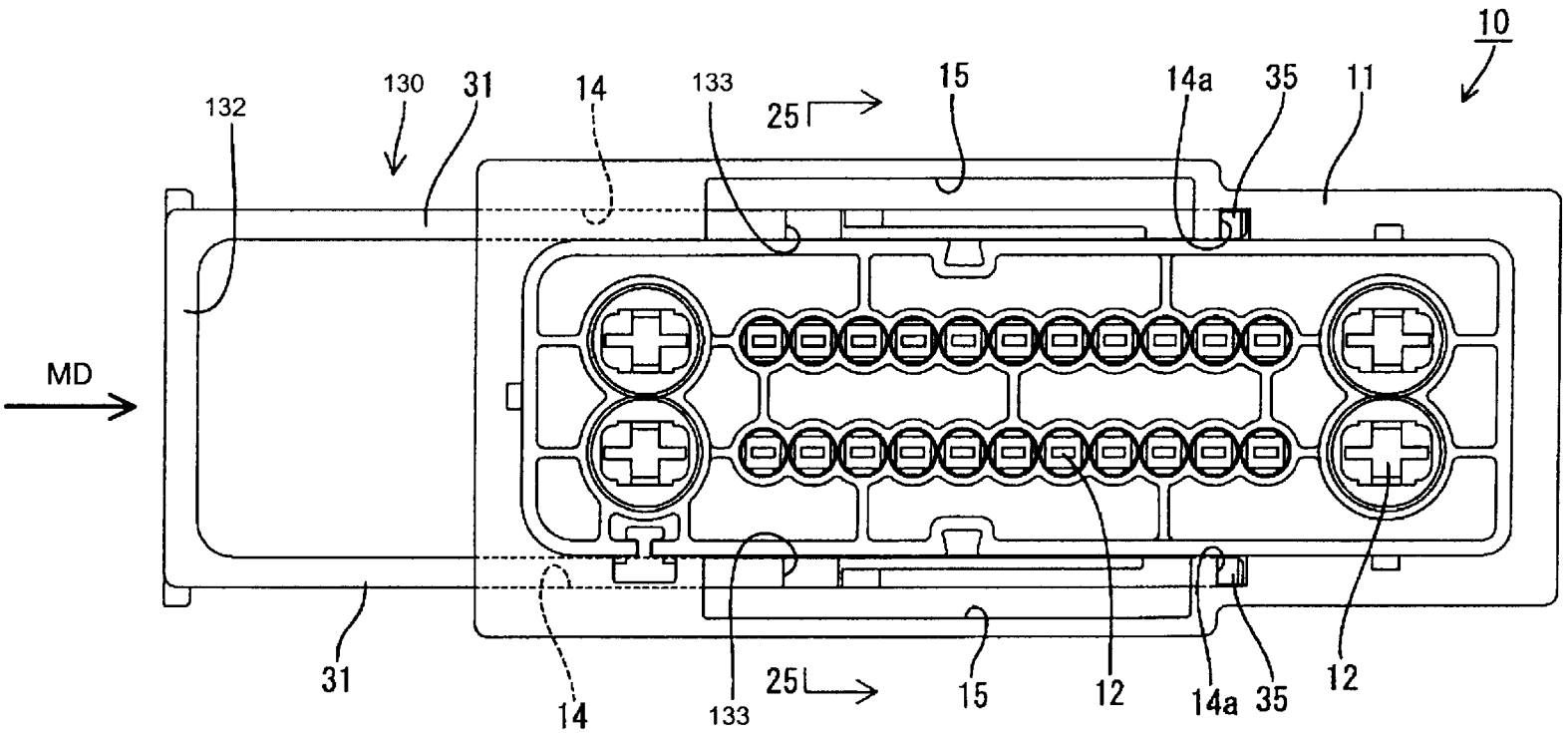
FIG. 23 is a plan view showing a state where a wire cover and the lever are detached in the first connector.
Figure 24:
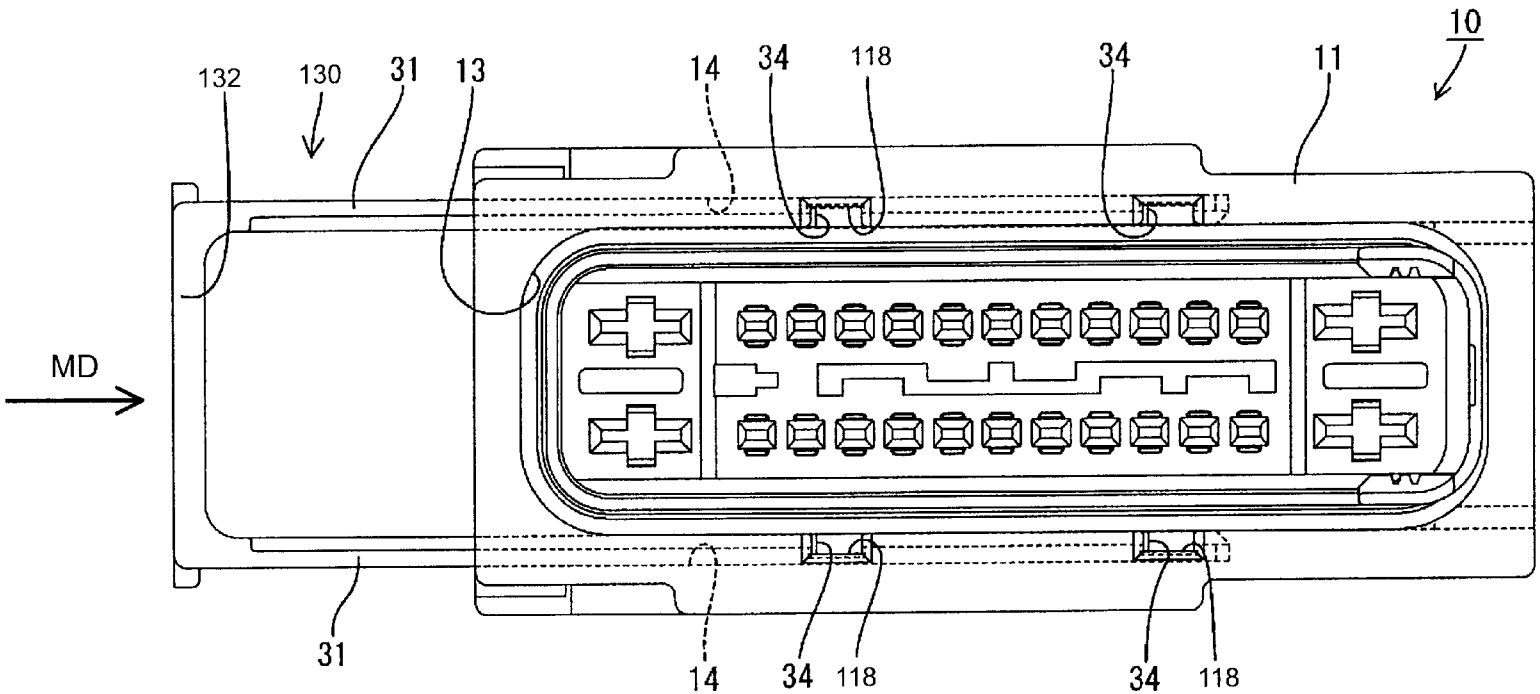
FIG. 24 is a bottom view of the first connector.
Figure 25:
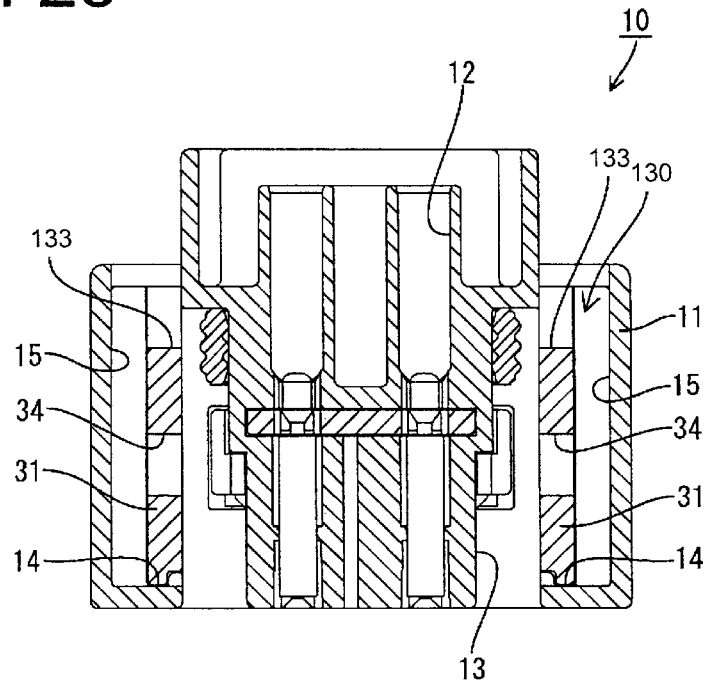
FIG. 25 is a section along 25—25 of FIG. 23.
Figure 26:
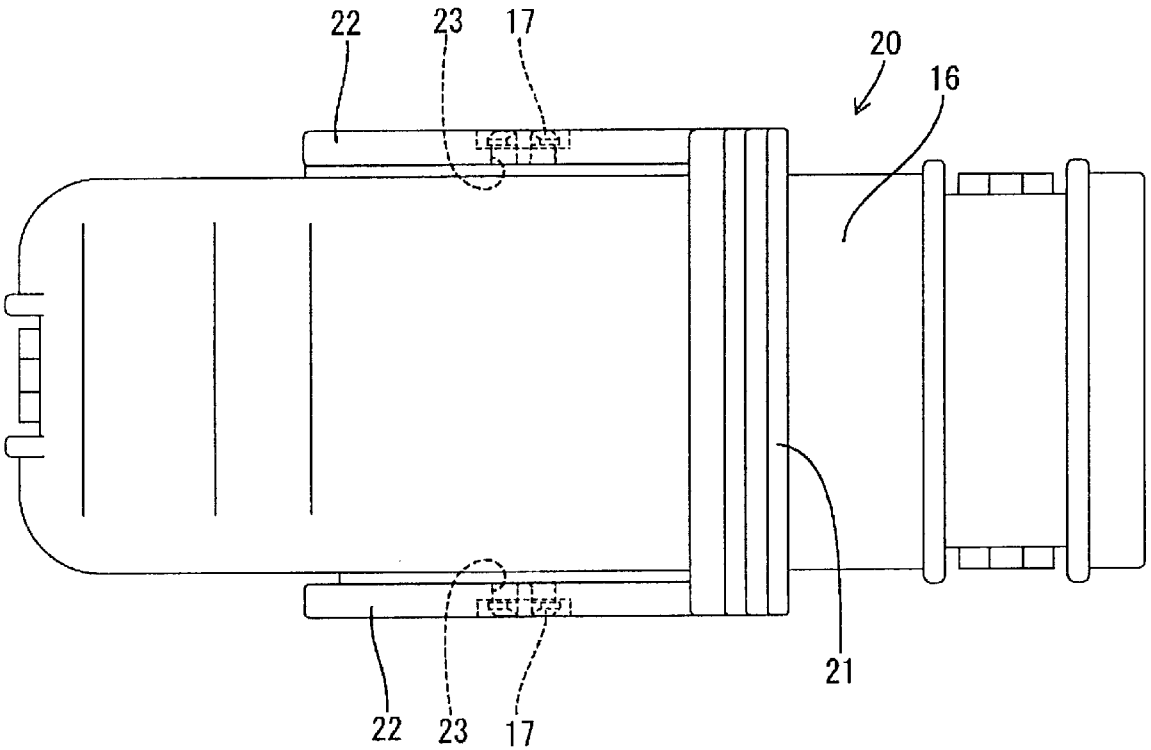
FIG. 26 is a plan view of the wire cover and the lever.
Figure 27:
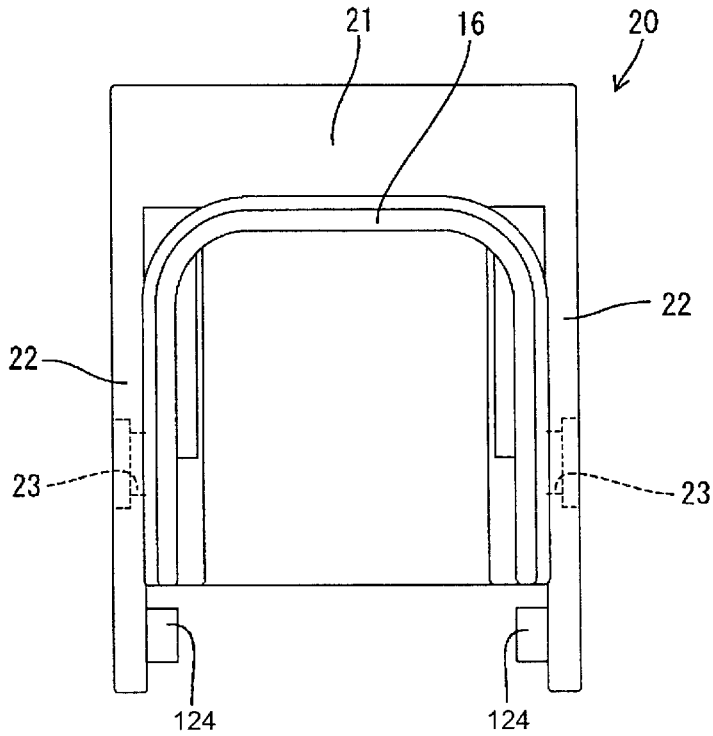
FIG. 27 is a rear view of the wire cover and the lever.
Figure 28:
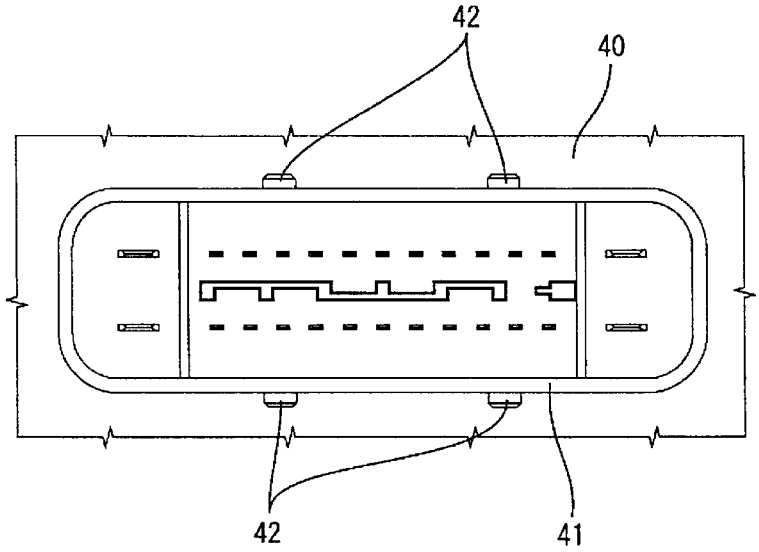
FIG. 28 is a plan view of the second connector.

The lever 20 is rotatable about the shafts 17 between an initial position (see FIGS. 19 and 20) where the rotating portion 21 is at the rear end of the wire cover 16 and the projections are located obliquely down to the front from the oblong holes 123 and a connection position (see FIG. 22) where the rotating portion 21 is at or towards the front end of the wire cover 16 and the projections 124 are located obliquely down to the back from the oblong holes 123. The oblong holes 123 are displaced with respect to the shafts 17. Thus, the center of rotation of the lever 20 is moved along and within the oblong holes 123 as the lever 20 is rotated.

The linking member 130 has left and right elongated movable plates 31 and a plate-shaped sliding portion 132 that connects the front ends of the movable plates 31. The linking member 130 is supported on the first connector 10 by slidably inserting the movable plates 31 into the corresponding guide slits 14 from the front. Thus, the linking member 130 is linearly slidable in forward and backward directions MD substantially normal to connecting directions CD of the first and second connectors 10, 40 between an initial position (see FIGS. 19 and 20) where the sliding portion 132 is spaced forward from the front end of the housing 11 and a connection position (see FIG. 22) more backward than the initial position.

Engaging recesses 133 are formed in the upper edges of the movable plates 31 of the linking member 130. The engaging recesses 133 have a widths along the moving direction MD and a depths along the connecting direction that are equal to or slightly larger than the diameter of the projections 124. Thus, the projections 124 can be fitted into the engaging portions 133 and can rotate without making loose vertical and transverse movements.

Each movable plate 31 of the linking member 130 has front and rear cam grooves 34 that extending oblique to both a moving direction MD of the linking member 130 and the connecting directions CD of the two connectors 10, 40. The cam grooves 34 sloped up and to the front, and the rear ends of the cam grooves 34 are open as entrances at the bottom edges of the movable plates 31. A resilient lock 35 is formed at the rear-upper corner of each movable plate 31, and the linking member 130 can be held at the initial position by engaging the resilient locks 35 with locks 14*a* at the upper walls of the guide slits 14. With the linking member 130 at the initial position, the entrances of the cam grooves 34 substantially register with guide holes 118 in the bottom walls of the guide slits 14 that open in the bottom surface of the housing 11.

The connector assembly also has a second connector 40 with an upwardly projecting rectangular tubular receptacle 41. The receptacle 41 is insertable into the engaging hole 13 of the first connector 10 in the connecting direction CD. Front and rear cam pins 42 project outward on each of the opposite side walls of the receptacle 41. The cam pins 42 enter the guide holes 118 of the first connector 10 as the receptacle 41 is fitted into the engaging hole 13.

The projections 124 and the linking member 130 form a cam functioning means 139 that connects the two connectors 10, 40 by the cam action of the engagement of the cam grooves 34 and the cam pins 42 as the lever 20 is rotated.

The two connectors 10, 40 are assembled by first supporting the lever 20 on the wire cover 16 at the initial position and holding the linking member 130 at the initial position in the housing 11. The bottom ends of the arms 22 then are inserted into the corresponding lever accommodating grooves 15 and the projections 124 are engaged with the engaging portions 133 (see FIG. 19). Thereafter, the first connector 10 is so fit lightly into the engaging hole 13 around the receptacle 41 of the second connector 40. Then, the cam pins 42 enter the cam grooves 34 through the guide holes 118 (see FIG. 20).

Figure 21:
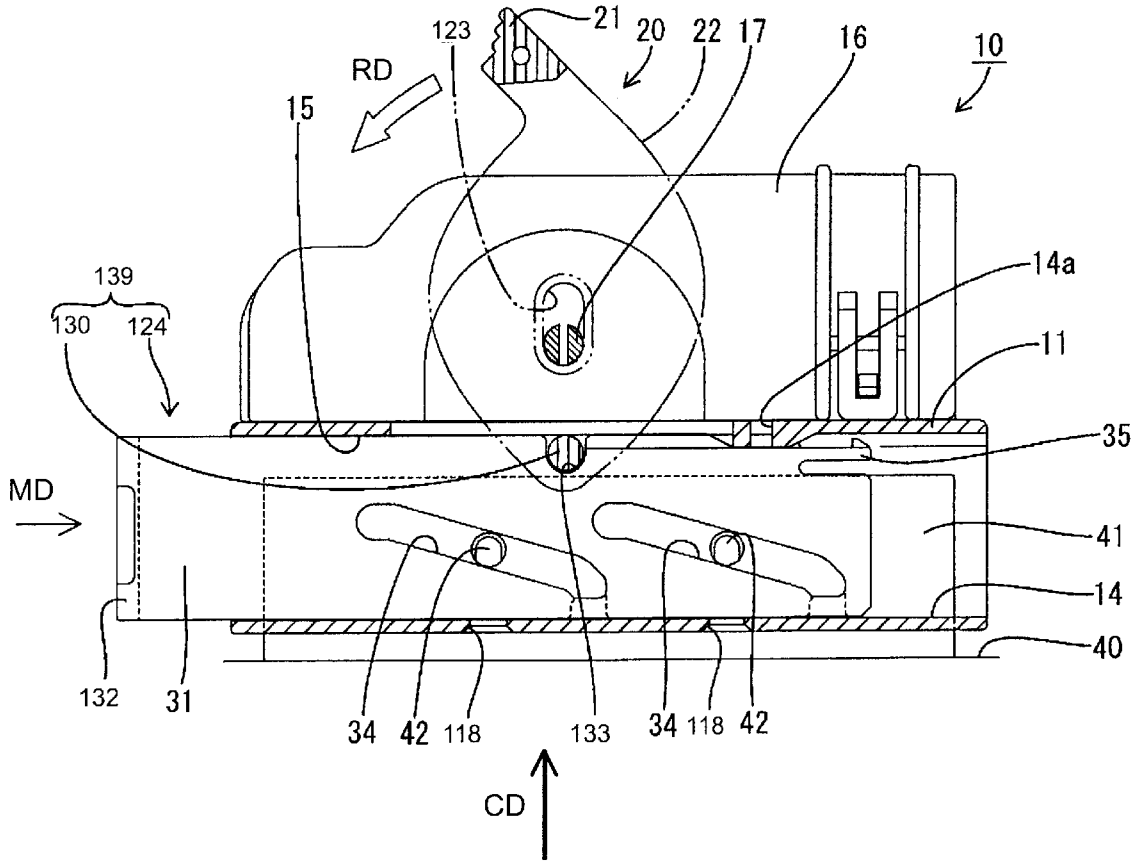
FIG. 21 is a side view in section showing an intermediate stage of rotation of a lever.

A hand or fingers can placed on the rotating portion 21 of the lever 20 to push the rotating portion 21 forward above the wire cover 16 for rotating the lever 20 in the rotating direction RD from the initial position towards the connection position. As the lever 20 is rotated, the projections 124 push the inner walls of the engaging portions 133 (see FIG. 21). Consequently, the linking member 130 is linked with the lever 20 and slid from the initial position to the connection position. The cam action is displayed by the engagement of the cam grooves 34 and the cam pins 42 accompanying the movement of the linking member 130. The two connectors 10, 40 are pulled toward each other and properly connected by this cam action (see FIG. 22).

The height of the projections 124 along the connecting directions of the two connectors 10, 40 is constant while the lever 20 is rotated since the projections 124 are moved together with the linking member 130. However, the lever 20 is supported on the wire cover 16 by the round shafts 17 engaged in the oblong holes 123. The lever 20 rotates about the shafts 17 of the wire cover 16 but the oblong holes 123 also permit displacement.

The linking member 130 can be selected instead of the lever 20 as an operable means for connecting the two connectors 10, 40. In such a case, a hand or fingers push the sliding portion 132 of the linking member 130 in the moving direction MD and back toward the housing 11. Thus, the linking member 130 is slid from the initial position towards the connection position. As the linking member 130 is moved, the cam action is displayed by the engagement of the cam grooves 34 and the cam pins 42. Further, as the linking member 130 is moved linearly, the inner walls of the engaging portions 133 push the projections 124 back. Consequently, the lever 20 is rotated in the rotating direction RD from the initial position to the connection position while being linked with the linking member 130.

As described above, the linking member 130 has the cam grooves 34 and is relatively displaceable with respect to the first connector 10. Additionally, the linking member 130 is linked with the connecting operation of the two connectors 10, 40 by the engagement of the cam grooves 34 and the cam pins 42 of the second connector 40. The projections 124 project at the outer periphery of the lever 20 and engage with the engaging portion 132 of the linking member 130 to define a cam functioning means or linking means for connecting the two connectors 10, 40 by the cam action of the cam grooves 34 and the cam pins 42 as the lever 20 is rotated. The lever 20 can be rotated with the projections 124 engaged with the linking member 130. Thus, the cam action of the cam grooves 34 and the cam pins 42 is displayed and the linking member 130 is displaced with respect to the first connector 10.

Specifically, it is not necessary to form the cam grooves in the lever 20 because the cam grooves 34 realizing the cam action are in the linking member 130. Accordingly, the entrances of the cam grooves 34 need not be formed in the outer peripheries of the arms 22, and the strength of the outer peripheral portion of the lever 20 is not reduced by the formation of the cam grooves.

Further, while the lever 20 is rotated, the projections 124 on the lever 20 are moved linearly with the linking member 130. In this embodiment, as the lever 20 is rotated, the center of rotation of the lever 20 moves shifts within the oblong holes 123. Thus, the rotation of the lever 20 and the sliding movement of the linking member 130 can be smoothly made.

Further, a hand can be placed on the sliding portion 132 to slide the linking member 130. Thus, the two connectors 10, 40 can be connected by the cam action of the cam grooves 34 and the cam pins 42 while the lever 20 is rotated with the engaging portions 133 and the projections 124 engaged with each other. Accordingly, an operator can select either rotating the lever 20 or sliding the linking member 130 to connect the two connectors 10, 40, thereby presenting good operability.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the slider is moved normal to the connecting directions of the two connectors in the foregoing embodiment, the moving direction of the slider may be oblique to the connecting directions of the two connectors.

The detectors are in the first connector and engage the slider in the first embodiment. However, they may be in the slider and engaged with the first or second connector according to the present invention.

Although the detectors are in the first connector in the first embodiment, they may be in the second connector.

The lever is rotatable while being linked with the movement of the slider in the first embodiment. However, the connectors may be connected only by operating the slider without providing the lever.

The linking mean of the first embodiment may comprise projections on the lever and grooves formed in the slider.

The linking mean of the second embodiment may comprise grooves formed in the lever and projections provided on the slider.

In the first and second embodiments, the displacing direction of the rotating portion of the lever and that of the sliding portion of the slider may be substantially same.

Although one lever and one slider are provided in the foregoing embodiments, two or more of the lever and/or the slider may be provided.

In the fourth embodiment, the linking member is separate from the connectors and supported on the first connector, and the cam grooves are engaged with the cam pins on the second connector. However, the second connector may function as the linking member. In such a case, the projections of the lever may function as the cam pins, the cam grooves may be formed in the second connector, and the projections of the lever and the cam grooves of the second connector may be engaged.

Although the oblong holes of the lever and the round shafts of the first connector are engaged with each other in the fourth embodiment, round shafts provided on the lever and oblong holes formed in the first connector may be engaged with each other according to the present invention.

Although the center of the rotation of the lever is relatively displaced with respect to the first connector as the lever is rotated in the fourth embodiment, it may not be displaced according to the present invention. In such a case, the engaging portions of the linking member may be formed into vertically extending oblong holes.

What is claimed is:

1. A connector assembly, comprising:

a first connector and a second connector movable along a connecting directions from an unconnected condition to a fully connected condition;

a slider linearly movable on the first connector between an initial position and a connection position in a moving direction aligned at an angle to the connecting directions of the two connectors;

cam means between the slider and the second connector for moving the first and second connectors into the fully connected condition as the slider is moved from the initial position toward the connection position;

a detecting member displaceable between a standby position and a detection position; and a movement detecting means for keeping the detecting member at the standby position before the slider reaches the connection position and permitting a displacement of the detecting member to the detection position only after the slider reaches the connection position so that movement of the detecting member to the detection position confirms movement of the first and second connectors to the fully connected condition.

2. The connector of claim 1, wherein the cam means comprises:

a cam groove provided in one of the slider and the second connector and extending in a direction oblique to both the moving direction of the slider and the connecting directions of the connectors; and a cam pin provided on the other of the slider and the second connector and engageable with the cam groove.

3. The connector of claim 1, wherein:

the slider is formed with a recess, and when the slider reaches the connection position, the recess aligns substantially with the detecting member and the detecting member fits into the recess.

4. The connector of claim 3, wherein before the slider reaches the connection position, the recess is not aligned with the detecting member and the detecting member located at the standby position interferes with the slider, thereby preventing the displacement thereof to the detection position.

5. A connector assembly comprising:

a first connector and a second connector connectable with each other along a connecting direction;

a slider linearly movable on the first connector between an initial position and a connection position in a moving direction aligned at an angle to the connecting direction of the two connectors;

cam means between the slider and the second connector for connecting the first and second connectors as the slider is moved from the initial position toward the connection position;

a detecting member on the first connector and being displaceable between a standby position and a detection position; and a movement detecting means for keeping the detecting member at the standby position before the slider reaches the connection position and wherein the recess of the slider substantially aligns with the detecting member when the slider is in the connection positioned for permitting a displacement of the detecting member to the detection position an at least partly into the recess only after the slider reaches the connection position.

6. The connector of claim 5, wherein the detecting member is provided at such a position that an operable portion of the slider is near the detecting member when the slider is moved to the connection position.

7. A connector assembly, comprising:

a first connector and a second connector connectable with each other by movement along a connecting direction;

a lever rotatably provided on the first connector for rotation in a rotating direction;

a slider slidably movable on the first connector along a moving direction intersecting connecting direction and substantially opposite to the rotating direction of the lever, the slider comprising first and second substantially parallel plates slidably engaged adjacent the first connector and an operable portion extending unitarily between the plates for receiving pushing forces to urge the slider in the moving direction;

a cam pin on the second connector;

linking means on the lever and the slider for linking rotation of the lever with sliding movement of the slider; and a cam groove on one of the lever and the slider and engageable with the cam pin to display cam action in response to either of a rotation the lever and a sliding of the slider.

8. A lever-type connector assembly, comprising:

a first connector having a lever rotatably supported thereon for rotation about a rotational axis, a second connector connectable with the first connector by movement along a connecting direction substantially perpendicular to the rotational axis of the lever, a cam functioning means for connecting the two connectors by the cam action of a cam groove and a cam pin as the lever is rotated, wherein the cam functioning means comprises:

a linking member relatively displaceable along a moving direction with respect to the first connector while being linked with a connecting operation of the connectors, the moving direction of the linking member being substantially perpendicular to the rotational axis of the lever and substantially perpendicular to the connecting direction of the second connector with the first connector, and a projection projecting at the outer periphery of the lever and engageable with the linking member, wherein the cam action of the cam groove and the cam pin is displayed while the linking member is displaced with respect to the first connector as the lever is rotated with the projection engaging the linking member.

9. The connector assembly of claim 8, wherein the linking member includes the cam groove.

10. The connector assembly of claim 9, wherein the cam pin is on the second connector.

11. A lever-type connector assembly, comprising:

a first connector having a lever rotatably supported thereon for rotation about a rotational axis, a projection projecting at the outer periphery of the lever, a second connector connectable with the first connector by movement along a connecting direction, the second connector being formed with a cam pin, a linking member relatively displaceable with respect to the first connector by movement along a movement direction intersecting the connecting direction, the linking member being form with a cam groove engageable with the cam pin on the second connector, the linking member further includes an engaging portion engageable with the projection on the outer periphery of the lever such that the projection is movable together with the linking member, wherein a cam action of the cam groove and the cam pin is displayed for connecting the two connectors as the lever is rotated and wherein the linking member is displaced with respect to the first connector as the lever is rotated with the projection engaging the engaging portion of the linking member.

12. The connector assembly of claim 11, wherein the lever is rotatably supported on the first connector by the engagement of an oblong hole and a shaft.

13. The connector assembly of claim 12, wherein the linking member includes a sliding portion for sliding the linking member.

* * * * *